US007913710B2

(12) United States Patent
Bougioukos

(10) Patent No.: US 7,913,710 B2
(45) Date of Patent: Mar. 29, 2011

(54) SHADING SYSTEMS

(76) Inventor: Vasileios Bougioukos, Attica (GR)

( * ) Notice: Subject to any disclaimer, the term of this patent is extended or adjusted under 35 U.S.C. 154(b) by 61 days.

(21) Appl. No.: 11/781,897

(22) Filed: Jul. 23, 2007

(65) Prior Publication Data

US 2008/0016786 A1 Jan. 24, 2008

Related U.S. Application Data

(60) Provisional application No. 60/833,192, filed on Jul. 24, 2006, provisional application No. 60/833,535, filed on Jul. 25, 2006, provisional application No. 60/868,715, filed on Dec. 5, 2006.

(51) Int. Cl.
*E04D 1/34* (2006.01)

(52) U.S. Cl. ..... 135/87; 135/94; 52/4; 52/745.06

(58) Field of Classification Search ..... 135/87, 135/93, 94, 97, 156, 117, 908, 90; 52/4, 52/745.06

See application file for complete search history.

(56) References Cited

U.S. PATENT DOCUMENTS

| | | | | |
|---|---|---|---|---|
| 238,550 | A | 3/1881 | Bailey | |
| 590,706 | A * | 9/1897 | Lentz et al. | 160/54 |
| 3,242,620 | A | 3/1966 | Kaiser | |
| 3,424,178 | A | 1/1969 | Yazaki | |
| 3,870,061 | A | 3/1975 | Lowery | |
| 4,558,713 | A | 12/1985 | Hagler et al. | |
| 4,683,901 | A | 8/1987 | Mitchell | |
| 5,546,971 | A | 8/1996 | Leonhardt | |
| 5,573,026 | A * | 11/1996 | Griffith | 135/122 |
| 5,597,005 | A * | 1/1997 | Thomas | 135/87 |
| 5,839,462 | A | 11/1998 | Randall | |
| 5,862,633 | A * | 1/1999 | Van Ells | 52/16 |
| 5,862,826 | A | 1/1999 | Gremont | |
| 6,155,280 | A * | 12/2000 | Powell et al. | 135/124 |
| 6,575,853 | B1 | 6/2003 | O'Neill et al. | |
| 6,662,816 | B1 * | 12/2003 | Cunningham | 135/94 |
| 6,766,623 | B1 | 7/2004 | Kalnay | |
| 6,823,883 | B1 * | 11/2004 | Sears | 135/128 |
| 7,240,683 | B2 * | 7/2007 | Zutich | 135/87 |
| 7,392,816 | B2 * | 7/2008 | Porter et al. | 135/123 |
| 2003/0131539 | A1 | 7/2003 | Burford et al. | |
| 2004/0074157 | A1 | 4/2004 | Chazal | |
| 2004/0134146 | A1 * | 7/2004 | Brown | 52/301 |
| 2005/0194030 | A1 * | 9/2005 | Goldwitz | 135/121 |

FOREIGN PATENT DOCUMENTS

| | | |
|---|---|---|
| GR | 1003516 | 6/2000 |
| GR | 1004861 | 9/2004 |

OTHER PUBLICATIONS http://partytentcity.com/, Party Tent Discount Canopy, Tents, Awnings, Camping, Wedding, Awning, date of publication unknown, 1 page, Internet.

* cited by examiner

*Primary Examiner* — David Dunn
*Assistant Examiner* — Noah Chandler Hawk
(74) *Attorney, Agent, or Firm* — Stoneman Law Patent Group; Martin L. Stoneman

(57) ABSTRACT

A system for improved exterior shading devices of highly adaptable configurations. The system comprises several cantilever shade structures usable in the shading of land vehicles.

28 Claims, 27 Drawing Sheets

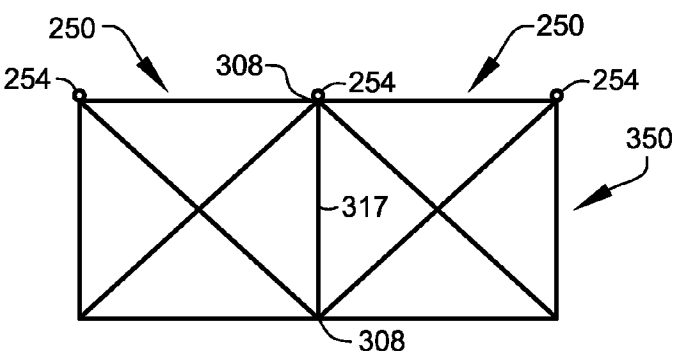
FIG. 44
FIG. 45
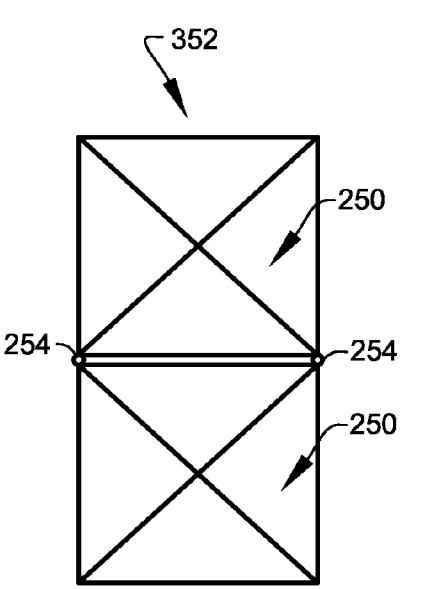
FIG. 48
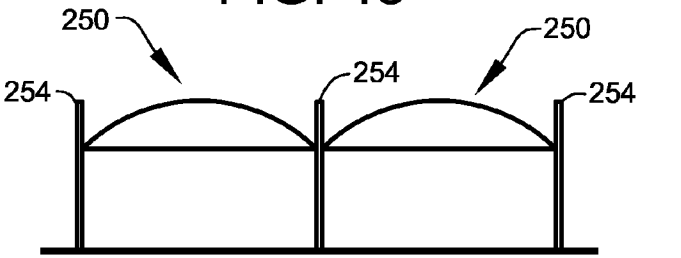
FIG. 46
FIG. 47
FIG. 49
FIG. 50

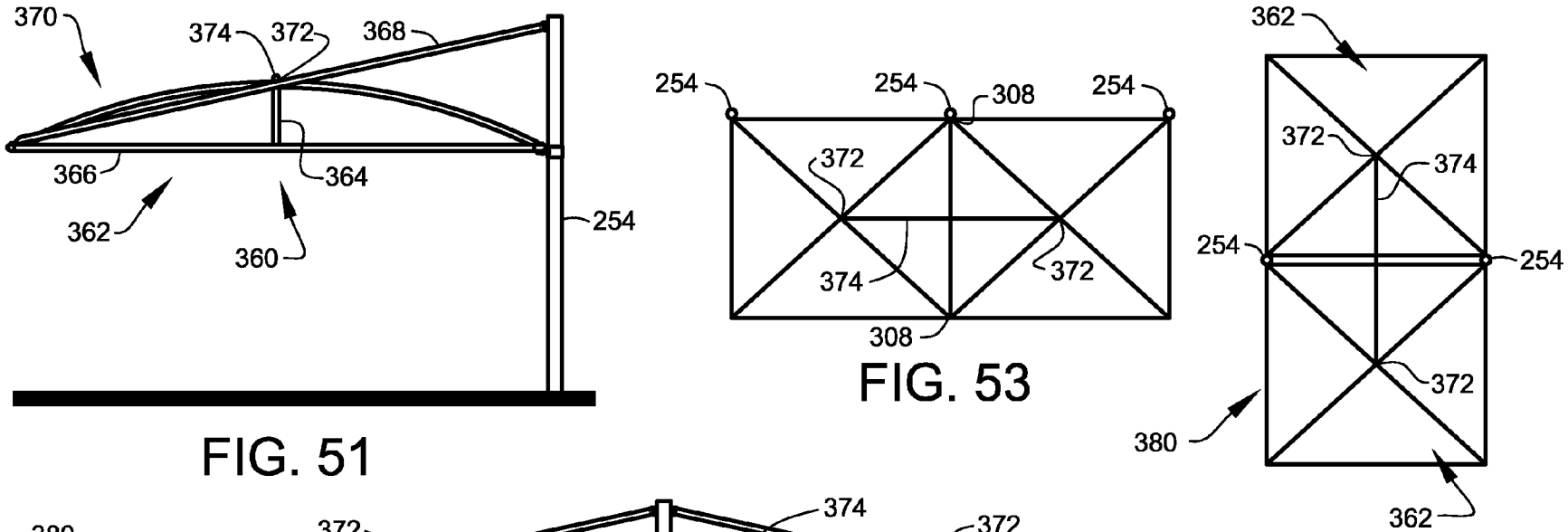
FIG. 51
FIG. 53
FIG. 54
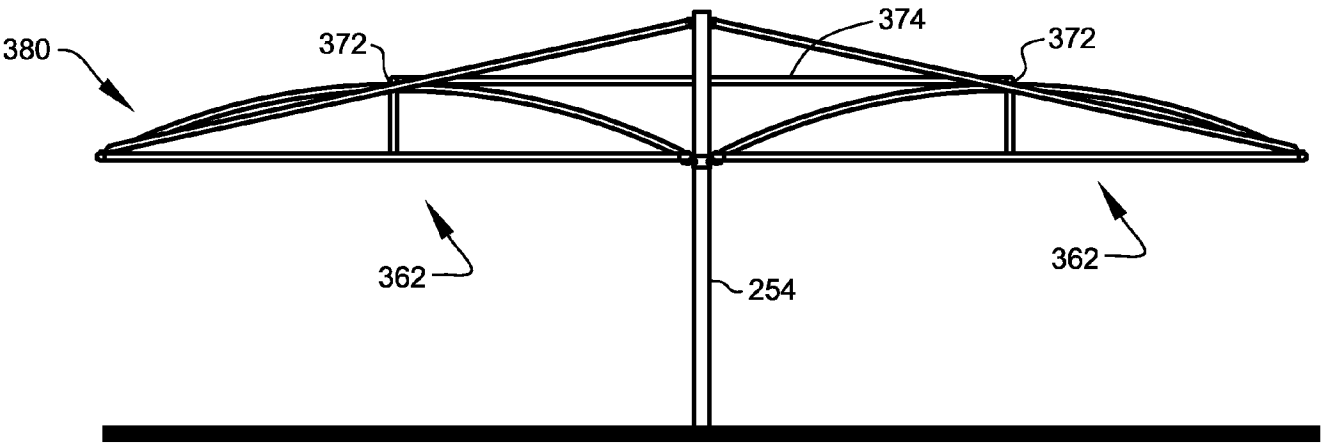
FIG. 52

SHADING SYSTEMS

CROSS-REFERENCE TO RELATED APPLICATIONS

The present application is related to and claims priority from prior provisional application Ser. No. 60/868,715, filed Dec. 5, 2006, entitled "SHADING SYSTEMS", and is related to and claims priority from prior provisional application Ser. No. 60/833,535, filed Jul. 25, 2006, entitled "SHADING SYSTEMS", and is related to and claims priority from prior provisional application Ser. No. 60/833,192, filed Jul. 24, 2006, also entitled "SHADING SYSTEMS", the contents of each of which are incorporated herein by this reference and are not admitted to be prior art with respect to the present invention by the mention in this cross-reference section.

BACKGROUND

This invention relates to providing a system for improved shading systems. More particularly this invention relates to providing a system for improved exterior shading devices of highly adaptable configurations. Furthermore, this invention relates to shading canopies for outdoor spaces without props.

Typically, exterior shading structures are relatively expensive and inefficient to produce an install. These factors greatly reduce the prevalence of their use. Therefore, a need exists for an improved exterior shading structure system having highly adaptable features at a low cost.

OBJECTS AND FEATURES OF THE INVENTION

A primary object and feature of the present invention is to provide a system to overcome the above-described problems It is a further object and feature of the present invention to provide such a system comprising cantilevered fabric shade structures and braced fabric shade structures. Each embodiment is preferably adaptable to be used as outdoor automobile parking covers.

A further primary object and feature of the present invention is to provide such a system that is efficient, inexpensive, and handy. Other objects and features of this invention will become apparent with reference to the following descriptions. If you are

SUMMARY OF THE INVENTION

In accordance with a preferred embodiment hereof, this invention provides a wind relief system, relating to at least one shading structure supporting flexible shade elements positioned to provide shading during daylight times, comprising: at least one first flexible shade element having at least one first peripheral portion; at least one second flexible shade element having at least one second peripheral portion; at least one first bar supported within such at least one shading structure in a first position; at least one second bar supported within such at least one shading structure in a second position substantially parallel to such first position; at least one first connection connecting such at least one first peripheral portion to such at least one first bar; and at least one second connection connecting such at least one second peripheral portion to such at least one second bar; wherein at least one of such first and second bars comprises at least one flexible shade support; wherein such wind relief system is structured and arranged such that air flow into such first and second flexible shade elements bends such at least one flexible shade support to open air space between such at least one first peripheral portion and such at least one second peripheral portion; and wherein air may non-destructively flow through such at least one shading structure. Moreover, it provides such a wind relief system wherein such first flexible shade element and such at least one second flexible shade element each comprise at least one shade fabric. Additionally, it provides such a wind relief system further comprising such at least one shading structure. Also, it provides such a wind relief system wherein such at least one shading structure comprises: a plurality of primary support members to support such at least one first bar and such at least one second bar above at least one adjacent ground structure; wherein each primary support member of such plurality comprises at least one generally vertical support segment structured and arranged to be supported by such at least one adjacent ground structure, at least one substantially horizontal cantilevered segment to support substantially horizontally such at least one first bar and such at least one second bar, and at least one radius segment to smoothly transition such at least one generally vertical support segment to such at least one substantially horizontal cantilevered segment. In addition, it provides such a wind relief system wherein such at least one peripheral edge portion comprises: a continuous cord having a plurality of spaced cord loops; wherein such continuous cord is firmly attached with such at least one substantially flexible shade fabric along such at least one peripheral edge portion; wherein at least one center of each of such plurality of spaced cord loops is situated at a distance from such cord attachment along such at least one peripheral edge portion; and wherein each of such plurality of spaced cord loops is structured and arranged to assist connection of such at least one shade fabric to at least one of such at least one first bar and such at least one second bar. And, it provides such a wind relief system wherein: such at least one first bar comprises a substantially rigid member extending transversely between a least two primary support members of such plurality; and such at least one second bar comprises at least one substantially flexible cable extending transversely between a least two of such primary support members of such plurality.

In accordance with another preferred embodiment hereof, this invention provides a wind relief system, relating to at least one shading structure supporting flexible shade elements positioned to provide shading during daylight times, comprising: at least one first flexible shade element having at least one first peripheral portion; at least one second flexible shade element having at least one second peripheral portion; wherein such second peripheral portion comprises structural supports and comprises at least two end portions; at least one first bar supported within such at least one shading structure in a first position; at least one second bar supported within such at least one shading structure in a second position spaced from and substantially parallel to such first position; at least one first connection connecting such at least one first peripheral portion to such at least one first bar; and a plurality of flexible restraints respectively connecting each of such at least two end portions with such at least one second bar; and wherein air may non-destructively flow through such at least one shading structure through spaces between such second peripheral portion and such at least one first bar.

In accordance with another preferred embodiment hereof, this invention provides a cantilever-supported horizontal shade system comprising: a plurality of substantially vertical pole structures, each such vertical pole structure comprising at least one first pole end-portion and at least one second pole end-portion; a plurality of cantilever bar elements each respectively supported by and extending from such plurality of substantially vertical pole structures; respectively each supported by at least one of such plurality of cantilever bar elements, a plurality of substantially horizontal flexible shade elements positioned to provide shading during daylight times; and a plurality of ground-mounted sleeves each respectively structured and arranged to transfer force loads to an adjacent ground structure; wherein each such ground-mounted sleeve comprises least one interior wall comprising at least one internal socket; wherein such least one at least one internal socket is sized to accommodate such at least first pole end-portion and interstitial placement of at least one packing material packable between such at least first pole end-portion and such at least one interior wall; wherein positional adjustments of such plurality of substantially horizontal flexible shade elements is provided by at least one positional adjustment of at least one such substantially vertical pole structure within such least one at least one internal socket; and wherein at least one preferred position of such plurality of substantially horizontal flexible shade elements is fixed by packing of such at least one packing material packable between such at least first pole end-portion and such at least one interior wall. Further, it provides such a cantilever-supported horizontal shade system further comprising: such at least one packing material; wherein such at least one packing material comprises at least one substantially inert granular material. Even further, it provides such a cantilever-supported horizontal shade system wherein: substantially all such at least one granular material passes an aperture having a diameter of about 12 millimeters; and such granular quality of such at least one packing material remains substantially unchanged by such packing.

In accordance with another preferred embodiment hereof, this invention provides a system, relating to assisting peripheral connection of at least one flexible shade element to at least one supporting bar, comprising: at least one flexible shade element having at least one peripheral edge portion; wherein such at least one peripheral edge portion comprises a continuous cord having a plurality of spaced cord loops; wherein such continuous cord is firmly attached with such at least one flexible shade element along such at least one peripheral edge portion; wherein at least one center of each of such plurality of spaced cord loops is situated at a distance from such cord attachment along such at least one peripheral edge portion; and wherein each of such plurality of spaced cord loops is structured and arranged to assist connection of such at least one flexible shade element to the at least one supporting bar.

In accordance with another preferred embodiment hereof, this invention provides a cantilever-supported horizontal shade system comprising: a plurality of substantially vertical pole structures; a plurality of cantilever bar elements each respectively supported by and extending from such plurality of substantially vertical pole structures; and respectively each supported by at least one of such plurality of cantilever bar elements, a plurality of substantially horizontal flexible shade elements positioned to provide shading during daylight times; wherein such plurality of substantially horizontal flexible shade elements are adjacently situated to provide larger-area shade; and at least one flexible shade assister structured and arranged to provide shading, during daylight times, to shade at least one interstice between such adjacently situated horizontal flexible shade elements.

In accordance with another preferred embodiment hereof, this invention provides a cantilever-supported shade system comprising: at least one substantially vertical pole structure; at least one cantilever bar element, having at least one inner end portion and at least one extending end portion, supported by and extending from such at least one substantially vertical pole structure; supported at least partially by such at least one cantilever bar element, at least one flexible shade element positioned to provide shading during daylight times; at least one vertical support system, having at least one stowed arrangement and at least one deployment arrangement, structured and arranged, when deployed, to provide auxiliary vertical support to such at least one extending end portion; and at least one deployment assistance system structured and arranged to assist in deployment of such at least one vertical support system; wherein auxiliary support for such cantilever bar element may be provided to support unusual weights supported by such at least one flexible shade element. Moreover, it provides such a cantilever-supported shade system wherein such at least one vertical support system comprises: at least one vertical support member structured and arranged to support by supportive contact with at least one adjacent ground surface; at least one pivot coupler structured and arranged to pivotally couple such at least one vertical support member to such at least one extending end portion; and at least one retainer to retain such at least one vertical support member in such at least one stowed arrangement; wherein such at least one stowed arrangement positions such at least one vertical support member substantially adjacent such at least one extending end portion. Additionally, it provides such a cantilever-supported shade system wherein: additional loading of such at least one flexible shade element results in downward deflection of such at least one extending end portion; the vertical deployed length of such at least one vertical support is less than the vertical distance between such at least one extending end portion, at about the location of such at least one pivot coupler, and the at least one adjacent ground surface; such vertical deployed length allows complete deployment of such at least one vertical support under a first magnitude of such additional loading of such at least one flexible shade element; and the downward deflection of such at least one extending end portion, under a second magnitude of such additional loading of such at least one flexible shade element, brings such at least one vertical support into such supportive contact with the at least one adjacent ground surface; and such auxiliary support for such cantilever bar element is provided by such supportive contact.

In accordance with another preferred embodiment hereof, this invention provides a cantilever-supported-umbrella shade system comprising: a plurality of substantially vertical pole structures; a plurality of cantilever bar elements each respectively supported by and extending from such plurality of substantially vertical pole structures; and supported by at least one of such plurality of cantilever bar elements, at least one flexible umbrella shade element positioned to provide umbrella shading during daylight times; wherein each such at least one flexible umbrella shade element comprises four umbrella corners substantially defining a rectangle; and wherein each such at least one flexible umbrella shade element is peripherally supported by four straight peripheral-portion elements, each such peripheral-portion element extending between two of such four umbrella corners; and wherein each such flexible shade element is shaped by a set of interconnected internal support elements, each such set including at least one corner pole element, of such internal support elements, terminating adjacent at least one such substantially vertical pole structure; and at least one adjustable support system to support such at least one flexible umbrella shade element in such position; wherein such at least one adjustable support system comprises a plurality of support devices structured and arranged to assist adjustable setup and strengthening of such cantilever-supported-umbrella shade system. Also, it provides such a cantilever-supported-umbrella shade system wherein at least one of such plurality of support devices comprises: at least one vertically-adjustable sleeve member situate on at least one such substantially vertical pole structure and situate adjacent at least one pole-adjacent one of such four umbrella corners; and at least one first connector structured and arranged to connect at least one such straight peripheral-portion element, having an end portion adjacent such at least one pole-adjacent one of such four umbrella corners, to such at least one vertically-adjustable sleeve member; whereby vertical adjustment of such at least one vertically-adjustable sleeve member may adjust positions of such straight peripheral-portion element to overcome geometrical inconsistencies. In addition, it provides such a cantilever-supported-umbrella shade system wherein at least one of such plurality of support devices comprises: at least one vertically-adjustable sleeve member situate on at least one such substantially vertical pole structure and situate adjacent at least one pole-adjacent one of such four umbrella corners; and at least one second connector structured and arranged to connect at least one such corner pole element, having an end portion adjacent such at least one pole-adjacent one of such four umbrella corners, to such at least one vertically-adjustable sleeve member; whereby vertical adjustment of such at least one vertically-adjustable sleeve member may adjust positions of such corner pole element to overcome geometrical inconsistencies. And, it provides such a cantilever-supported-umbrella shade system wherein at least one of such plurality of support devices comprises: at least one vertically-adjustable sleeve member situate on at least one such substantially vertical pole structure and situate adjacent at least one pole-adjacent one of such four umbrella corners; and at least one third connector structured and arranged to connect at least one such straight peripheral-portion element, having an end portion adjacent such at least one pole-adjacent one of such four umbrella corners, to such at least one vertically-adjustable sleeve member; and connect at least one such corner pole element, having an end portion adjacent such at least one pole-adjacent one of such four umbrella corners, to such at least one vertically-adjustable sleeve member; whereby vertical adjustment of such at least one vertically-adjustable sleeve member may adjust positions of such straight peripheral-portion element and such corner pole element to overcome geometrical inconsistencies. Further, it provides such a cantilever-supported-umbrella shade system wherein at least one of such plurality of support devices comprises: at least one apex connector structured and arranged to connect at least two such corner pole elements, each having an end portions adjacent such at least one pole-adjacent one of such four umbrella corners, to at least two other such corner pole elements; wherein such at least one apex connector comprises at least one adjustable pivot to provide pivotal adjustment of angular relationships between such corner pole elements; whereby pivotal adjustment of the angular relationships between such corner pole elements may adjust at least one distance relationship between such four umbrella corners to overcome geometrical inconsistencies. Even further, it provides such a cantilever-supported-umbrella shade system wherein at least one of such plurality of support devices comprises: at least one fourth connector structured and arranged to connect at least one first such straight peripheral-portion element, of at least one first at least one flexible umbrella shade element to at least one second such straight peripheral-portion element, of at least one second at least one flexible umbrella shade element; wherein such at least one fourth connector comprises at least one first coupler to couple such at least one fourth connector with such at least one first such straight peripheral-portion element, at least one second coupler to couple such at least one fourth connector with such at least one second such straight peripheral-portion element, and at least one third coupler structured and arranged to couple such at least one fourth connector to at least one third such straight peripheral-portion element; wherein such at least one third such straight peripheral-portion element is shared by such at one first at least one flexible umbrella shade element and such at one second at least one flexible umbrella shade element. Even further, it provides such a cantilever-supported-umbrella shade system wherein such at least one first coupler and such at least one second coupler are structured and arranged to maintain such at least one first such straight peripheral-portion element and such at least one second such straight peripheral-portion element in a substantially co-axial arrangement. Even further, it provides such a cantilever-supported-umbrella shade system further comprising: at least one visual separator comprising at least one spaced set of substantially horizontal bars to provide spaced horizontal support extending between at least two such substantially vertical pole structures, at least one substantially flexible separator, at least one attacher to attach such at least one substantially flexible separator to such at least one spaced set of substantially horizontal bars, and at least one bar mount to mount such at least one spaced set of substantially horizontal bars to vertical portions of such at least two such substantially vertical pole structures; wherein mounting of such at least one substantially flexible separator to such at least two such substantially vertical pole structures provides visual separation between such at least two such substantially vertical pole structures.

In accordance with another preferred embodiment hereof, this invention provides a method of assembling at least one umbrella shade assembly, such at least one umbrella shade assembly comprising connectable umbrella structural components forming at least one umbrella apex, such method comprising the steps of: providing a loose assembly of such at least one umbrella shade assembly; applying at least one shade fabric to such at least one umbrella shade assembly; tightening such at least one shade fabric to such at least one umbrella shade assembly; providing at least one removable jack system to connect to such at least one umbrella apex; connecting such at least one removable jack system to such at least one umbrella apex of such at least one umbrella shade assembly before final firm connecting of such connectable umbrella structural components; vertical jacking of such at least one removable jack system until such at least one shade fabric is adequately taut; completing final firm connecting of such connectable umbrella structural components; and removing such at least one removable jack system from such at least one umbrella shade assembly.

In accordance with another preferred embodiment hereof, this invention provides a method of providing a wind relief system within at least one shading structure supporting flexible shade elements positioned to provide shading during daylight times, comprising the steps of: providing at least one first fabric panel having at least one first peripheral edge, such at least one first fabric panel comprising at least one flexible shade material; providing at least one second fabric panel having at least one second peripheral edge, such at least one second fabric panel comprising at least one flexible shade material; providing at least one first bar, supported within such at least one shading structure in a first position; providing at least one second bar, supported within such at least one shading structure in a second position substantially parallel to such first position; providing at least one first connection connecting such at least one first peripheral edge to such at least one first bar; and providing at least one second connection connecting such at least one second peripheral edge to such at least one second bar; wherein such wind relief system is structured and arranged such that air flow into such at least one first fabric panel and such at least one second fabric panel bends such at least one flexible shade material to open at least one air passage between such at least one first peripheral edge and such at least one second peripheral edge; and wherein air may non-destructively flow through such at least one shading structure.

In accordance with another preferred embodiment hereof, this invention provides a method relating to the installation of at least one shade support member comprising the steps of: placing at least one sleeve into at least one hole; surrounding the at least one sleeve with at least one concrete material; placing such at least one shade support member into such at least one sleeve; and positioning such at least one shade support member; and placing at least one depth controller inside the at least one sleeve so as to adjust the depth of such at least one shade support member. Furthermore, it provides such a method wherein such depth controller comprises a plurality of rocks. Even further, it provides such a method wherein such depth controller comprises at least one gravel. Even further, it provides such a method wherein such step of positioning comprises placing at least one wedge inside such at least one sleeve. Even further, it provides such a method wherein the at least one sleeve comprises at least one pipe. Even further, it provides such a method wherein the concrete-filled sleeve is stabilized by placing at least one collar on the top of such sleeve. Even further, it provides such a method wherein at least one portion of such at least one pipe comprises at least one Poly Vinyl Chloride material. Even further, it provides such a method wherein such at least one sleeve comprises at least one inner diameter greater than the outer diameter of each of such at least two shade support members.

In accordance with another preferred embodiment hereof, this invention provides a cantilever-supported shade system related to solar shading, such system comprising: at least one flexible shade element structured and arranged to provide solar shading; at least one cantilevered shade support member structured and arranged to support such at least one flexible shade element in at least one position to provide such solar shading during daylight times; at least one substantially vertical secondary support member structured and arranged to provide secondary structural support substantially independent of such at least one shade support member; a common foundation support structured and arranged to stably support both such at least one shade support member and such at least one substantially vertical secondary support member from at least one adjacent ground structure; wherein such at least one shade support member comprises at least one substantially vertical base segment, and smoothly transitioning along at least one radius extending upwardly from such at least one substantially vertical base segment, at least one substantially horizontal end segment; wherein such at least one substantially vertical secondary support member comprises at least one connector bar structured and arranged to connect such at least one substantially vertical secondary support member to such at least one substantially horizontal end segment; and wherein such at least one connector bar is structured and arranged to provide auxiliary cantilevered support to such at least one extending end portion. Moreover it provides such a system wherein such at least one connector bar comprises: at least one first bar end and at least one second bar end; at least one first connector structured and arranged to connect such at least one first bar end to such at least one substantially vertical secondary support member; at least one second connector structured and arranged to connect such at least one second bar end to such at least one substantially horizontal end segment; wherein such at least one first connector and such at least one second connector each comprise at least one hinged connection. In addition, it provides such a system wherein: such at least one substantially vertical base segment comprises at least one substantially circular cross section comprising at least one first outer diameter; such at least one substantially vertical secondary support member comprises at least one substantially circular cross section comprising at least one second outer diameter; and such at least one substantially vertical base segment and such at least one substantially vertical secondary support member are separated by at least one distance not substantially greater than the combined diameters of such at least one first outer diameter and such at least one second outer diameter.

BRIEF DESCRIPTION OF THE DRAWINGS

FIG. 44 shows a top view diagram of a single unit of the umbrella-type shade module of FIG. 26.

FIG. 45 shows a rear view diagram of a single unit of the umbrella-type shade module of FIG. 26.

FIG. 46 shows a side view diagram of a single unit of the umbrella-type shade module of FIG. 26.

FIG. 47 shows a top view diagram of a multiple unit of the umbrella-type shade module of FIG. 26, comprising a side-by-side configuration, according to a preferred embodiment of the present invention.

FIG. 48 shows a rear view diagram of the side-by-side configuration of FIG. 47.

FIG. 49 shows a top view diagram of a multiple unit of the umbrella-type shade module of FIG. 26, comprising a back-to-back configuration, according to a preferred embodiment of the present invention.

FIG. 50 shows a side view diagram of the back-to-back configuration of FIG. 49.

FIG. 51 shows a side view of a single umbrella-type shade module, comprising a modified support structure, according to an alternate preferred embodiment of the present invention.

FIG. 52 shows a side view of a double umbrella-type shade module, comprising the modified support structure of FIG. 51, according to an alternate preferred embodiment of the present invention.

FIG. 53 shows a top view of a double side-by-side umbrella-type shade module, comprising a modified support structure, according to another alternate preferred embodiment of the present invention.

FIG. 54 shows a top view of a double back-to-back umbrella-type shade module, comprising a modified support structure, according to the preferred embodiment of FIG. 52.

DETAILED DESCRIPTION OF THE BEST MODES AND PREFERRED EMBODIMENTS OF THE INVENTION

Figure 1:
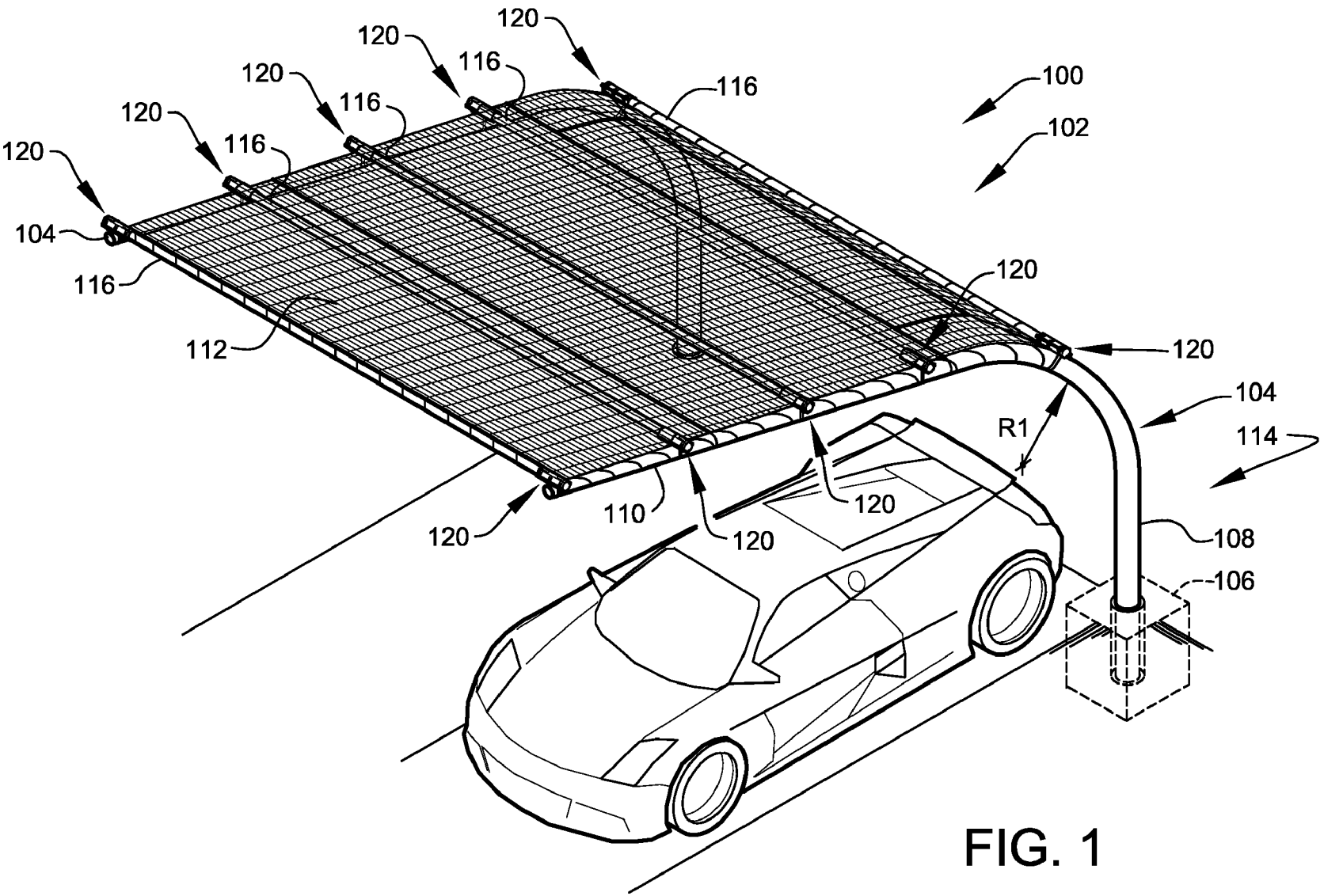
FIG. 1 shows a perspective view illustrating an arch-type shade module of an adaptable shade system according to a preferred embodiment of the present invention.

FIG. 1 shows a perspective view illustrating arch-type shade module 102, of shade system 100. Arch-type shade module 102 represents a single preferred embodiment within a range of preferred embodiments forming shade system 100. Shade system 100 generally comprises cantilevered shade structures assembled from one or more basic shade modules.

Arch-type shade module 102 is adapted to accommodate a wide range of useful functions, including the exterior protection of land vehicles, boats, and other valuable assets. The system is effective in protection against solar damage, bird-waste, and hail. The system is further adaptable to extend the usability of exterior spaces, including, loading docks, patio spaces, and pool decks. The system is effective in slowing the degradation of paving materials and provides a level of protection from snowfall unique to cantilevered shade structures. The illustration of FIG. 1 depicts arch-type shade module 102 protectively covering an automotive parking space.

Preferably, each arch-type shade module 102 comprises a span of flexible shade material 112 supported by a rigid structural frame 114, as shown. Flexible shade material 112 is preferably selected from materials providing environmental protection, most preferably solar protection through the control of ultraviolet (UVA-UVB) radiation levels. Preferably, structural frame 114 comprises a pair of primary support members 104 projecting upwardly from individual foundation structures 106, as shown. Preferably, the interspacing of the primary support members 104 establishes the width of a single module and most preferably comprises a center-to-center distance of about five meters.

Preferably, each primary support member 104 comprises a generally vertical support segment 108 (at least embodying herein at least one generally vertical support segment structured and arranged to be supported by such at least one adjacent ground structure) smoothly transitioning along radius R1 (at least embodying herein at least one radius segment to smoothly transition such at least one generally vertical support segment to such at least one substantially horizontal cantilevered segment) to form a nearly horizontal cantilevered segment 110, as shown (at least embodying herein at least one substantially horizontal cantilevered segment to support substantially horizontally such at least one first bar and such at least one second bar). Preferably, each primary support member 104 is constructed from a rigid structural material, preferably a metallic material, most preferably from a mild steel sheet having a thickness of at least about four millimeters (mm). Preferably, the mild steel sheet is rolled and welded to form a conically shaped hollow member having a base diameter of about 130 millimeters and an ending diameter of about 60 millimeters, as shown. Upon reading the teachings of this specification, those of ordinary skill in the art will now understand that, under appropriate circumstances, considering such issues as intended use, cost, material availability, local building codes, etc., other structural member arrangements, such as, "I" section members, "H" section members, wide-flange members, non-conical members, laminated wood members, etc., may suffice.

Preferably, primary support members 104 comprise a projecting length of about five meters and a maximum projecting height, as measured from the adjacent ground surface, of about two and one-half meters. Radius R1 preferably comprises a segment length of about one and one-half meters. Upon reading the teachings of this specification, those of ordinary skill in the art will now understand that, under appropriate circumstances, considering such issues as intended use, wind, loads, seismic loads, etc., other physical configurations, such as, structures of greater height, structures of greater cantilever spans, etc., may suffice.

Preferably, multiple secondary support members 116 form transverse links coupling the two primary support members 104, as shown. Each secondary support member 116 preferably comprises a substantially rigid bar, as shown. Each secondary support member 116 most preferably comprises an elongated hollow cylindrical shape, as shown. Preferably, secondary support member 116 is of metallic construction, most preferably consisting of mild steel having a wall thickness of about two millimeters. Preferably, each secondary support member 116 comprises an outside diameter of about 60 millimeters.

Figure 2:
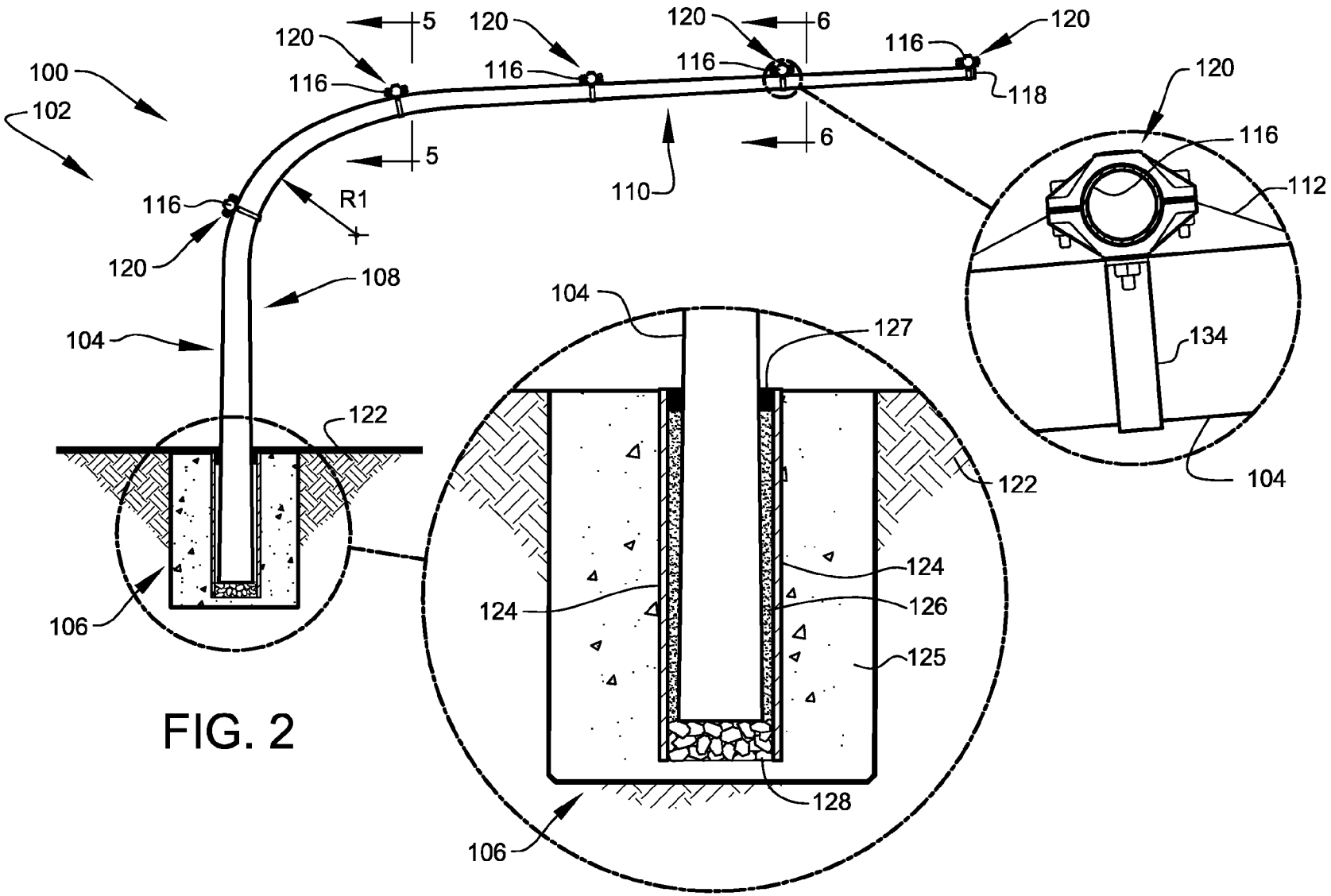
FIG. 2 shows a side view, in partial section, of the arch-type shade module, according to the preferred embodiment of FIG. 2.

FIG. 2 shows a side view, in partial section, of arch-type shade module 102, according to the preferred embodiment of FIG. 2. FIG. 2 clearly illustrates the preferred arrangement of five secondary support members 116 approximately evenly spaced across primary support member 104 beginning at the end termination 118 of support member 104, extending across cantilevered portion 110 to about the lower point of transition between radius R1 and vertical support portion 108, as shown.

Preferably, each end of the secondary support members 116 is rigidly coupled to one of the two primary support members 104 using a transverse coupler assembly 120, as shown. The preferred structures and arrangements of transverse coupler assemblies 120 are illustrated and described in detail in FIG. 3.

Preferably, each primary support member 104 is positionally maintained in the depicted configuration by foundation structure 106, as shown. Preferably, foundation structure 106 (also identified herein as "footing", is placed substantially within ground soil 122 below the level of the ground surface, as shown. Preferably, foundation structure 106 is designed to transfer the loads generated by the structure of arch-type shade module 102 from primary support member 104 to the supporting ground soil 122. The ideal configuration of foundation structure 106 is generally influenced by local site and environmental conditions, which vary from region to region. Structural variables that are frequently considered when selecting a foundation design include wind and seismic loads, soil composition and bearing capacity, frost depth, and groundwater conditions. In addition, local foundation design practices and building codes often dictate specific foundation requirements.

The following example foundation design illustrates a highly preferred embodiment of foundation structure 106. This design has been found to be suitable for use in many regions of the world. The following footing design is not based on a site-specific geotechnical report but assumes that normal residual soils, having a minimum bearing capacity, will be encountered at the excavated depths. Alternate preferred foundation designs are provided in FIG. 62 and FIG. 63.

Preferably, foundation structure 106 comprises an isolated-type footing adapted to support both axial downward forces and overturning moments applied by the cantilevered structure. Preferably, foundation structure 106 comprises an enlarged geometric volume of solid material, most preferably a site-poured concrete material 125, as shown. Preferably, foundation structure 106 comprises a cubic-shaped volume having sides of preferably just over about one meter in length. Smaller footing dimensions are possible (down to slightly under about one meter square) as site conditions permit (soil capacity, wind loading, etc.). Upon reading the teachings of this specification, those of ordinary skill in the art will now understand that, under appropriate circumstances, considering such issues as regional methods of construction, number of footing to be placed, etc., other footing arrangements, such as, the use of auger-formed cylindrical footings, spread footings, pier-type footings, continuous or combined footings, etc., may suffice.

Preferably, a hollow sleeve 124 is placed in a substantially vertical orientation within the upper central portion of foundation structure 106, as shown. Preferably, concrete material 125 is poured around the base and sides of sleeve 124, without any concrete entering the interior of sleeve 124. Preferably, sleeve 124 is adapted to receive the lower end of primary support member 104, as shown. Preferably, sleeve 124 is adapted to transfer force loads from primary support member 104 to the surrounding concrete encasement and ground structures (at least embodying herein a plurality of ground-mounted sleeves each respectively structured and arranged to transfer force loads to an adjacent ground structure). Sleeve 124 preferably comprises a hollow cylindrical segment of rigid piping, most preferably a segment of six-inch diameter (15.2 centimeter) Poly Vinyl Chloride (PVC) pipe. Preferably, sleeve 124 extends from the upper surface of foundation structure 106 to a depth allowing at least about 50 centimeters (cm), most preferably at least about 70 cm of primary support member 104 to be inserted within foundation structure 106, shown.

Preferably, primary support member 104 is retained within foundation structure 106 by compacting the space between the interior of sleeve 124 and primary support member 104 with a packing material, more preferably an inert granular material, most preferably screeded dry sand 126, as shown. The use of densely packed sand allows for quick and efficient installation and field adjustment of primary support member 104 during initial construction. In addition, the use of packed sand addresses long-term environmental issues related to re-use of materials by allowing arch-type shade module 102 to be non-destructively removed and relocated. Preferably, sand 126 is screened to pass an aperture having a diameter of about 12 millimeters. Inert sand is preferably used because of its ability to form a densely packed encasement about the primary support member, while maintaining its inherent granular quality to facilitate later removal of primary support member 104. Preferably, the base elevation of primary support member 104 is established by installing an elevation control material, which most preferably comprises a supportive layer of gravel 128, to a measured elevation within sleeve 124, as shown. The lower end of primary support member 104 is lowered into sleeve 124 until it comes to bear on the gravel base, as shown. Prior to the installation of sand, vertical support portion 108 of primary support member 104 is adjusted for proper vertical orientation (plumbed). In a preferred method of installation, several wedge-shaped inserts are driven at appropriate points between vertical support portion 108 and the upper interior of sleeve 124. Once the preferred positioning of primary support member 104 is achieved, sand is packed and tamped around primary support member 104 up to within between about two centimeters and about eight centimeters of the top of sleeve 124, as shown. Preferably, the remaining upper portion of sleeve 124 is capped with a rigid protective material, most preferably a high-strength cement-based grout 127, as shown. Upon reading the teachings of this specification, those of ordinary skill in the art will now understand that, under appropriate circumstances, considering such issues as intended use, local codes, available materials, etc., other structural arrangements, such as, providing the primary support with a base plate that is mechanically fastened to anchors embedded within the footing, providing steel reinforcing bars/cages within the concrete footing, etc., may suffice. Additional teachings of related preferred methods of implementing shade modules of shade system 100 are presented in FIG. 56, FIG. 57, and FIG. 59.

Figure 3:
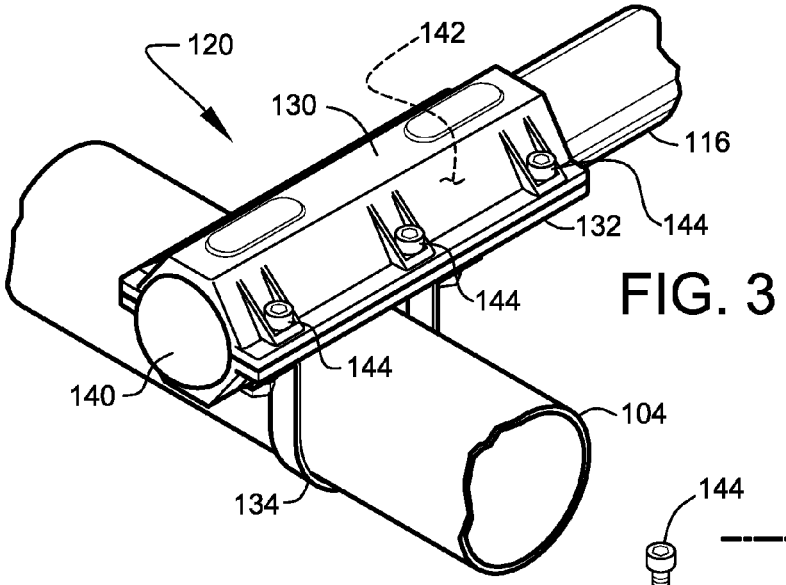
FIG. 3 shows a perspective view illustrating a preferred coupled connection between a primary support member and a secondary support member of the arch-type shade module of FIG. 1.
Figure 4:
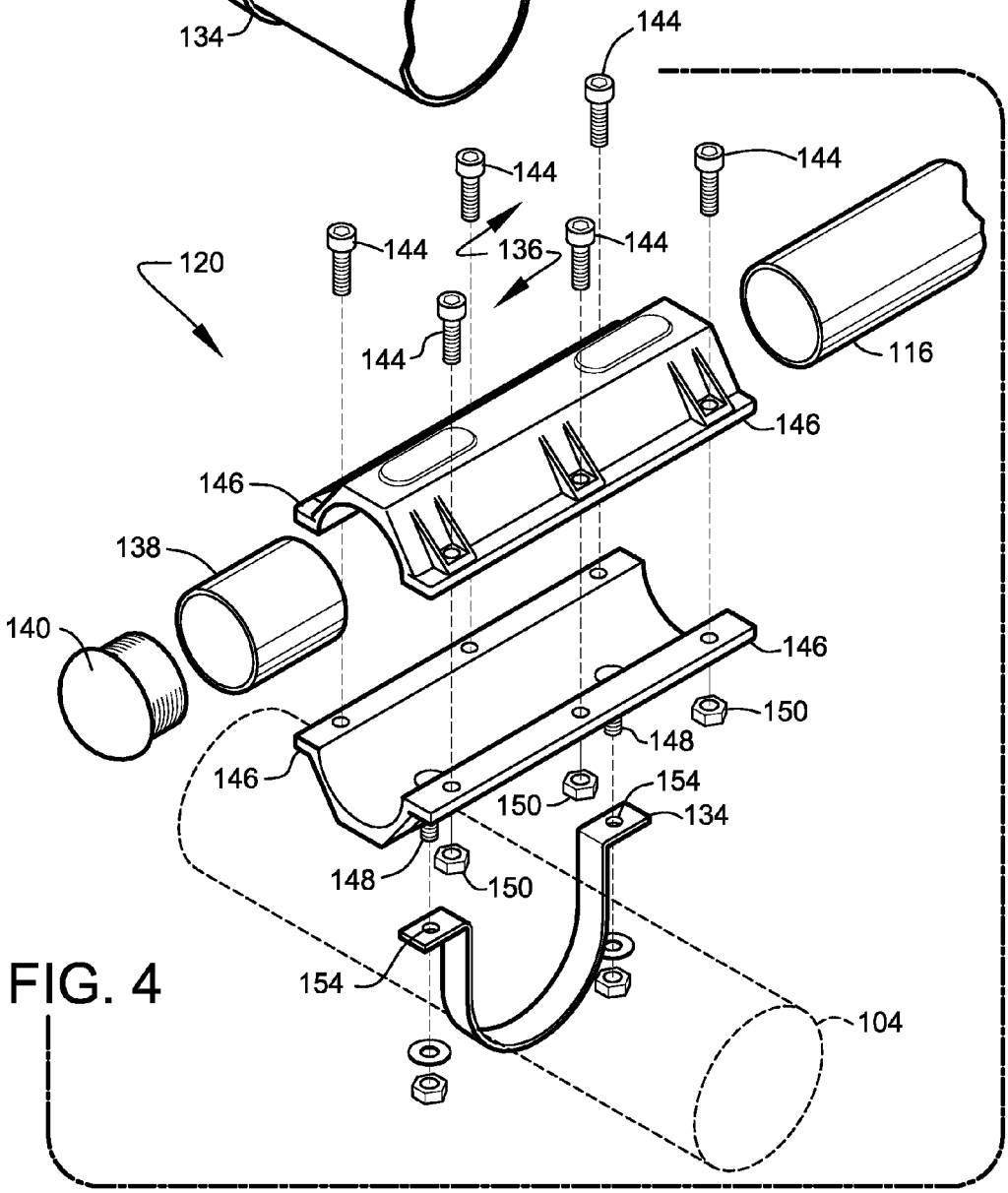
FIG. 4 shows an exploded view of a transverse coupler assembly of the coupled connection of FIG. 3.
Figure 5:
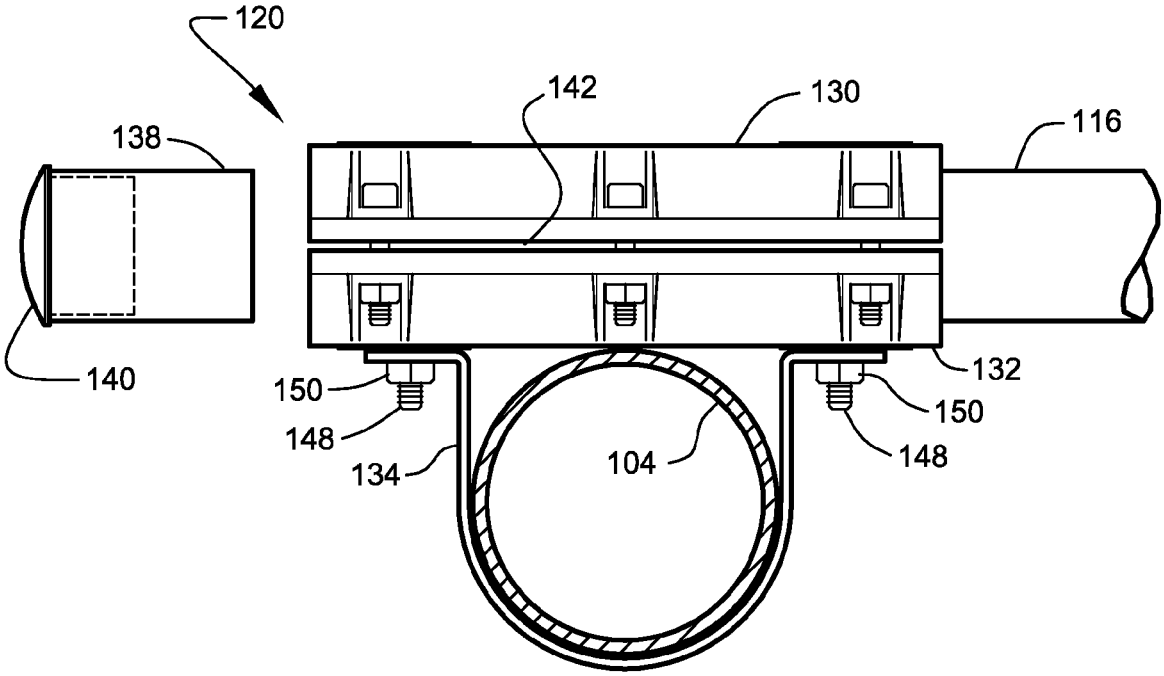
FIG. 5 shows the sectional view 5-5 of FIG. 2.
Figure 6:
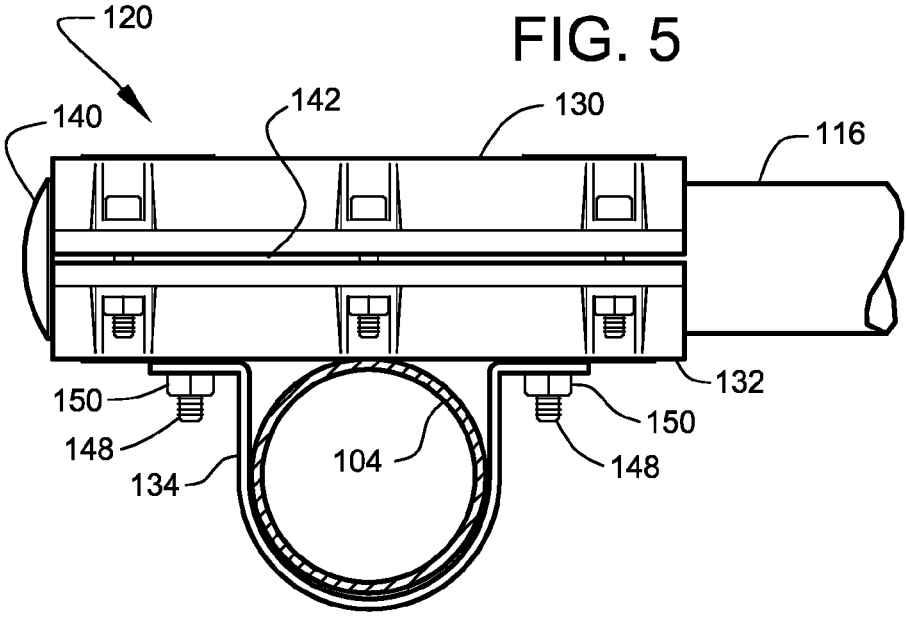
FIG. 6 shows the sectional view 6-6 of FIG. 2.

FIG. 3 shows a perspective view illustrating transverse coupler assembly 120 joining primary support member 104 and secondary support member 116 of the arch-type shade module 102 of FIG. 1. FIG. 4 shows an exploded view of transverse coupler assembly 120 of the coupled connection of FIG. 3. FIG. 5 shows the sectional view 5-5 of FIG. 2. FIG. 6 shows the sectional view 6-6 of FIG. 2.

Preferably, transverse coupler assembly 120 comprises an assembly of modular components identified herein as first compression block 130, second compression block 132, compression strap 134, and a fastener group 136 comprising threaded fasteners 144, as shown. Single shade modules and terminating modules within a series of coupled modules (see FIG. 22) preferably comprise additional fittings preferably comprising end pipe segment 138 and end cap 140, as shown.

Preferably, first compression block 130 and second compression block 132 together form a compressive clamp designed to compressively engage the outer circumference of secondary support member 116, as shown. Preferably, an internal compression channel 142 is formed by the arrangement of first compression block 130 adjacent second compression block 132 as depicted in FIG. 3. Preferably, the internal size of compression channel 142 is adjustable by tightening and loosening threaded fasteners 144 of fastener group 136, as shown. Preferably, threaded fasteners 144 are passed through apertures (see FIG. 10, apertures 156) within a set of flanges 146 located along longitudinal edges of first compression block 130 and second compression block 132, as shown. The tightening of threaded fasteners 144 preferably results in the impinging of the fasteners on the flange surfaces, resulting in the drawing of first compression block 130 toward second compression block 132.

Figure 7:
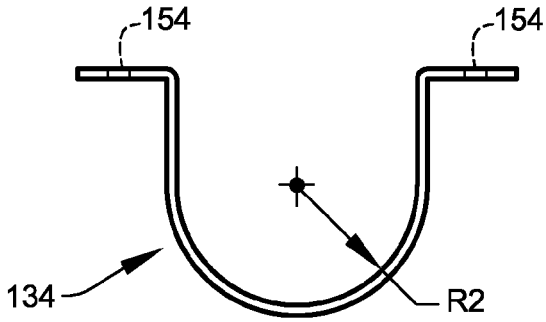
FIG. 7 shows a side view of the compression strap of the transverse coupler of FIG. 3.

FIG. 7 shows a side view of an isolated compression strap 134 of transverse coupler 120. Preferably, compression straps 134 are adapted to anchor transverse coupler 120 to the depicted points on primary support member 104. Preferably, each compression strap 134 comprises a modified U-shape adapted to encircle and compressively engage the outer surface of primary support member 104, as shown. Each of the compression straps 134 mounted along the primary support member 104 preferably comprises a unique inner diameter, each of the inner diameters generally corresponding to the outer diameter of the tapered primary support member 104, at its respective point of attachment. The illustrations of FIG. 5 and FIG. 6 clearly illustrate the preferred correspondence between strap size and the variable outer diameter of primary support 104 at the locations of the connection.

Preferably, second compression block 132 is modified to comprise a set of threaded studs 148 and threaded nuts 150, as shown. Preferably, transverse coupler 120 is mounted to primary support 104 by engaging compression strap 152 over primary support 104, passing threaded studs 148 through apertures 154 (located within wings of compression strap 152), and tightening threaded nuts 150 to draw second compression block 132 and compression strap 152 tightly against primary support 104.

Figure 9:
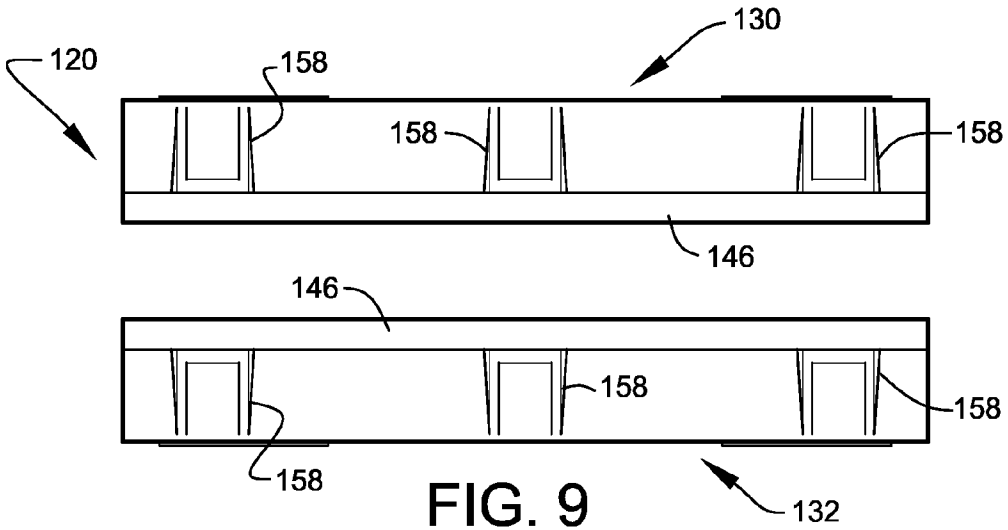
FIG. 9 shows a side view of the first compression block and the second compression block of the transverse coupler of FIG. 3.
Figure 8:
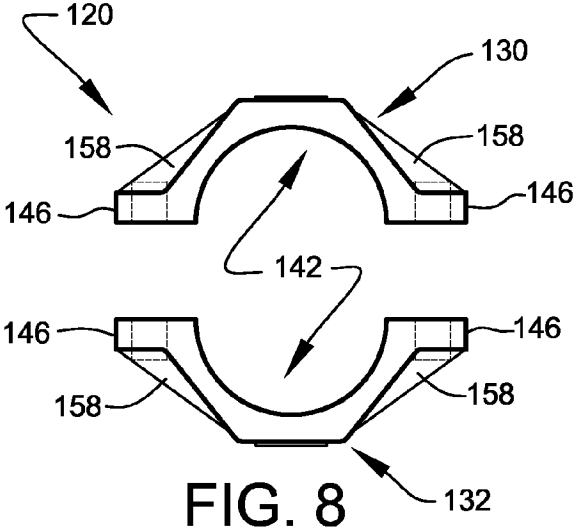
FIG. 8 shows an end view of a first compression block and a second compression block of the transverse coupler of FIG. 3.
Figure 10:
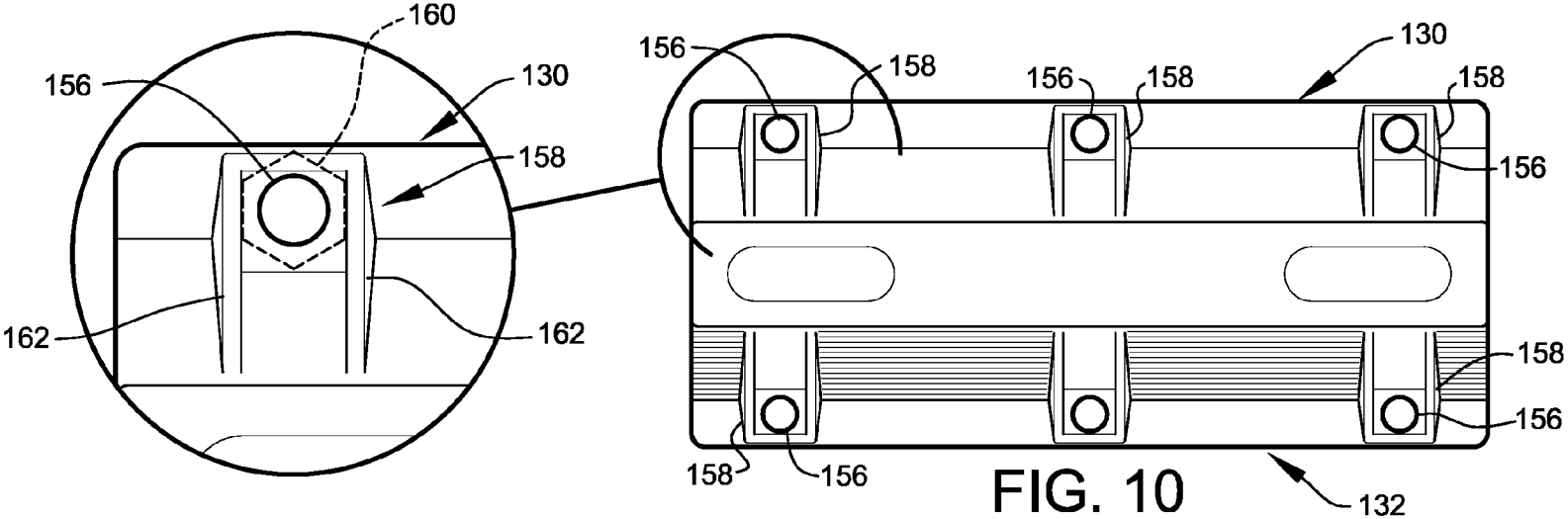
FIG. 10 shows a top view of the first compression block (the second compression block being substantially similar) of the transverse coupler of FIG. 3.

FIG. 8 shows an end view of first compression block 130 and second compression block 132 of transverse coupler 120. FIG. 9 shows a side view of first compression block 130 and second compression block 132 of transverse coupler 120. FIG. 10 shows a top view of first compression block 130 (second compression block 132 comprising a substantially similar configuration). Preferably, first compression block 130 and second compression block 132 each comprise a substantially identical casting of at least one rigid material, most preferably a metallic material, with aluminum being most preferred for cost, strength and durability. Preferably, each apertured flange 146 comprises a symmetrical arrangement of apertures 156 adapted to pass threaded fasteners 144, as shown. Preferably, an area of reinforcement identified herein as reinforced land 158 surrounds each aperture 156, as shown. Reinforced land 158 is preferably adapted to assist in redistributing concentrated load forces from the area of the threaded connection to the body of the casting, as shown. Preferably, as best illustrated in the detailed inset of FIG. 10, reinforced land 158 further comprises a pair of flanking walls 162 configured to restrain threaded nut 160 from rotation about the longitudinal axis of threaded fasteners 144. This highly preferred feature allows an assembler to install/tighten fasteners 144 using a single tool, thus greatly speeding the assembly process. Preferably, first compression block 130 and second compression block 132 are assembled using a symmetrical arrangement of six threaded fasteners 144, as shown.

Figure 11:
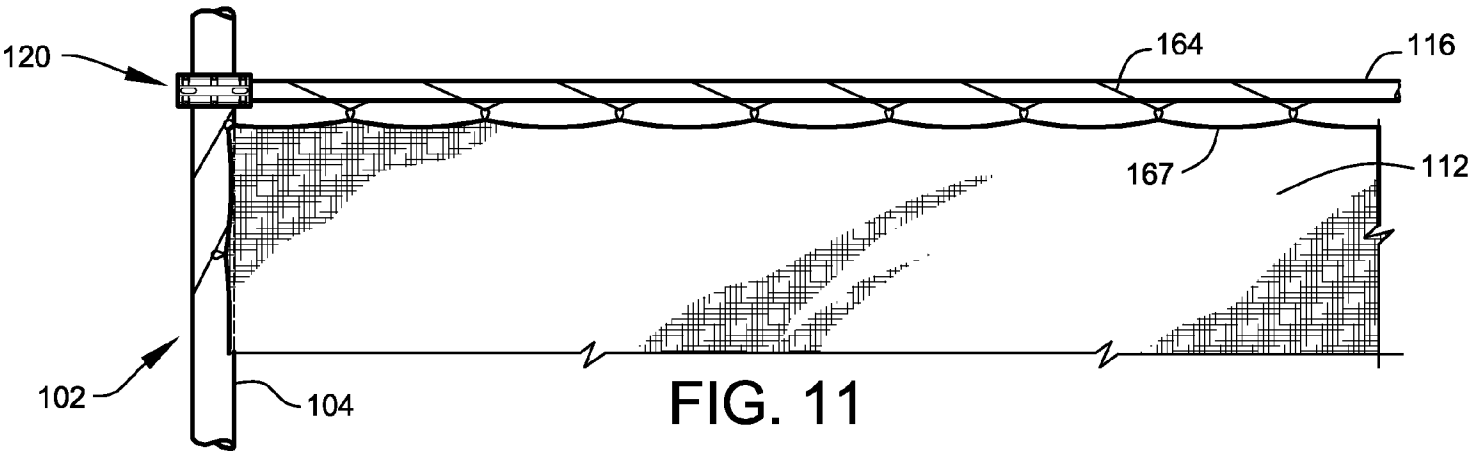
FIG. 11 shows a top view of a preferred laced attachment of shade fabric to the supporting structures of the arch-type shade module.
Figure 12:
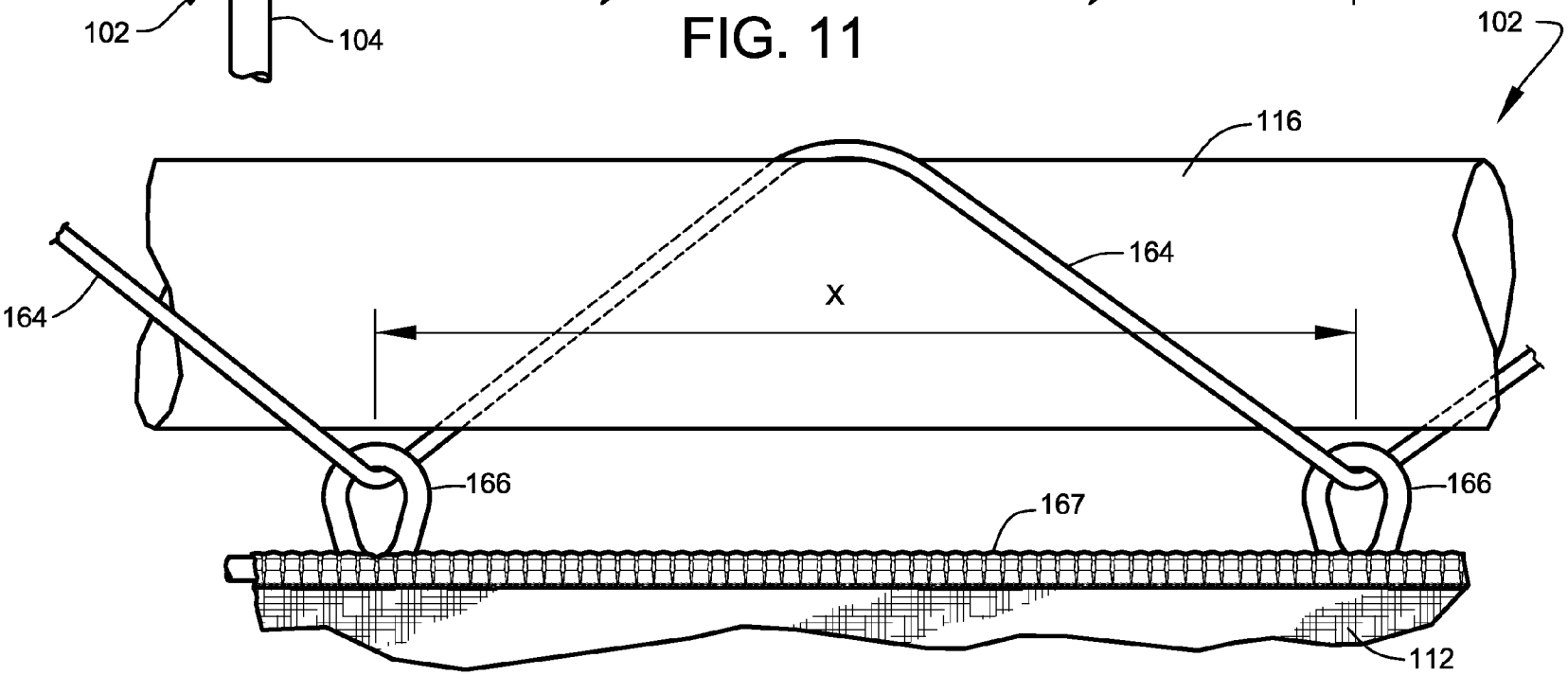
FIG. 12 shows a partial enlarged view of the laced attachment of the shade fabric to a transverse support member.

FIG. 11 shows a top view of a preferred laced attachment of flexible shade material 112 to the supporting structures of arch-type shade module 102. FIG. 12 shows a partial enlarged view of the laced attachment of flexible shade material 112 to transverse support member 116. Preferably, flexible shade material 112 is lashed to the structural framing preferably using flexible cord 164 that is spiral laced to the structural members of the shade module, as shown. Preferably, cord 164 is coupled to flexible shade material 112 by passing though a plurality of attachment points, preferably an arrangement of looped eyelets 166, spaced along peripheral edge 166 of flexible shade material 112, as shown. Preferably, looped eyelets 166 are evenly spaced along peripheral edge 166 at a center-to-center distance X of about 30 centimeters, as shown. Preferably, flexible shade material 112 is drawn taut by tensioning flexible cord 164. Preferably, flexible shade material 112 comprises polyethylene net material.

Figure 13:
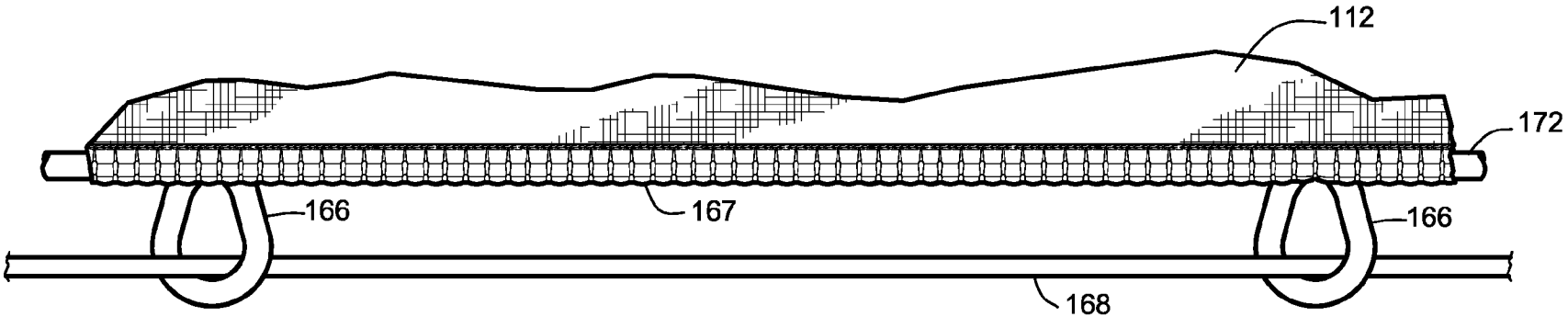
FIG. 13 shows a partial enlarged view of a cable-supported peripheral edge of the shade fabric.

FIG. 13 shows a partial enlarged view of a cable-supported peripheral edge 167 within flexible shade material 112, illustrating an alternate preferred lashing method. The preferred lashing arrangement of FIG. 13 utilizes at least one flexible member, preferably comprising flexible cable 168, as shown. Preferably, sufficient tension is applied to flexible cable 168 to produce a substantially linear cable configuration, as shown. Preferably, flexible cable 168 is situated generally parallel to peripheral edge 167, as shown. This preferred placement allows flexible cable 168 to engage each looped eyelet 166 along the length of peripheral edge 167, as shown. Preferably, the distal ends of flexible cable 168 are coupled to opposing anchor points within the structure of the shade module.

Figure 14:
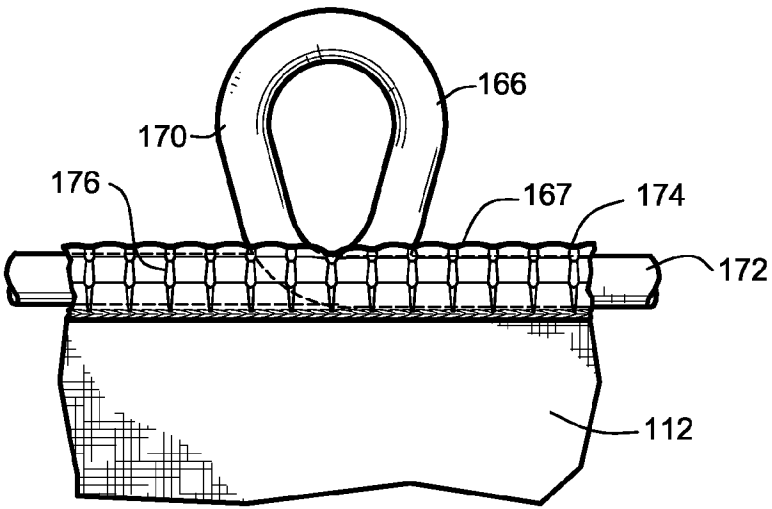
FIG. 14 shows an enlarged view illustrating a preferred edge-loop and related stitching of the shade fabric.

FIG. 14 shows an enlarged view illustrating preferred construction arrangements at looped eyelets 166 with preferred stitching of flexible shade material 112. Preferably, looped eyelet 166 is produced by forming twisted loop 170 within the reinforcing edge cord 172 of peripheral edge 167, as shown. Preferably, edge cord 172 is captured within a continuous linear pocket 174 formed by turning back the edge of flexible shade material 112 to produce the welt structure depicted in FIG. 14. Preferably, edge cord 172 is secured within continuous pocket 174 using edge stitching 176, preferably an over-edge locking stitch, as shown. Preferably, edge stitching 176 is formed using a compatible heavy-capacity thread applied by an industrial sewing machine used in fabrication of aquatic nets, such as, for example, a Buraschi pneumatic sewing machine produced in Biassono Milan (Italy). To further enhance durability of the seam, a continuous chain stitch may be applied to the raw edge of flexible shade material 112, as shown.

Preferably, flexible shade material 112 comprises a knitted synthetic fabric having a range of shade factors specifiable up to about 91 percent and solar UVA-UVB protections specifiable up to about 98 percent. Most preferably, flexible shade material 112 comprises a polyethylene-based net material. Preferably, edge cord 172 comprises braided synthetic cording having a nominal diameter of between about six millimeters and about ten millimeters.

Figure 15:
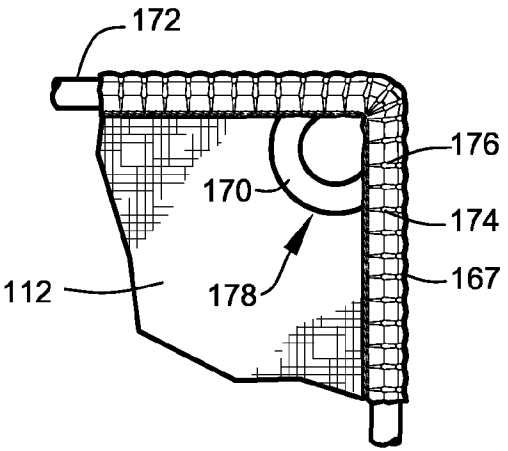
FIG. 15 shows an enlarged view illustrating a preferred corner-loop and related stitching of the shade fabric.

FIG. 15 shows an enlarged view illustrating a preferred corner-loop 178 and related stitching of the shade fabric. Preferably, corner-loop 178 is produced by forming a twisted loop 170 within edge cord 172 as peripheral edge 167 makes the angular transition between adjacent panel edges, as shown. Preferably, edge cord 172 runs continuously through the corner transition and is secured within continuous pocket 174 using edge stitching 176, preferably an over-edge locking stitch, as shown. Upon reading the teachings of this specification, those of ordinary skill in the art will now understand that, under appropriate circumstances, considering such issues as cost, wind loading, etc., other edge attaching arrangements, such as, grommets, reinforced panels, ties, cringles, etc., may suffice.

The above-described edge arrangements at least embody herein at least one flexible shade element having at least one peripheral edge portion; wherein such at least one peripheral edge portion comprises a continuous cord having a plurality of spaced cord loops; wherein such continuous cord is firmly attached with such at least one flexible shade element along such at least one peripheral edge portion; wherein at least one center of each of such plurality of spaced cord loops is situated at a distance from such cord attachment along such at least one peripheral edge portion; and wherein each of such plurality of spaced cord loops is structured and arranged to assist connection of such at least one flexible shade element to the at least one supporting bar.

Figure 16:
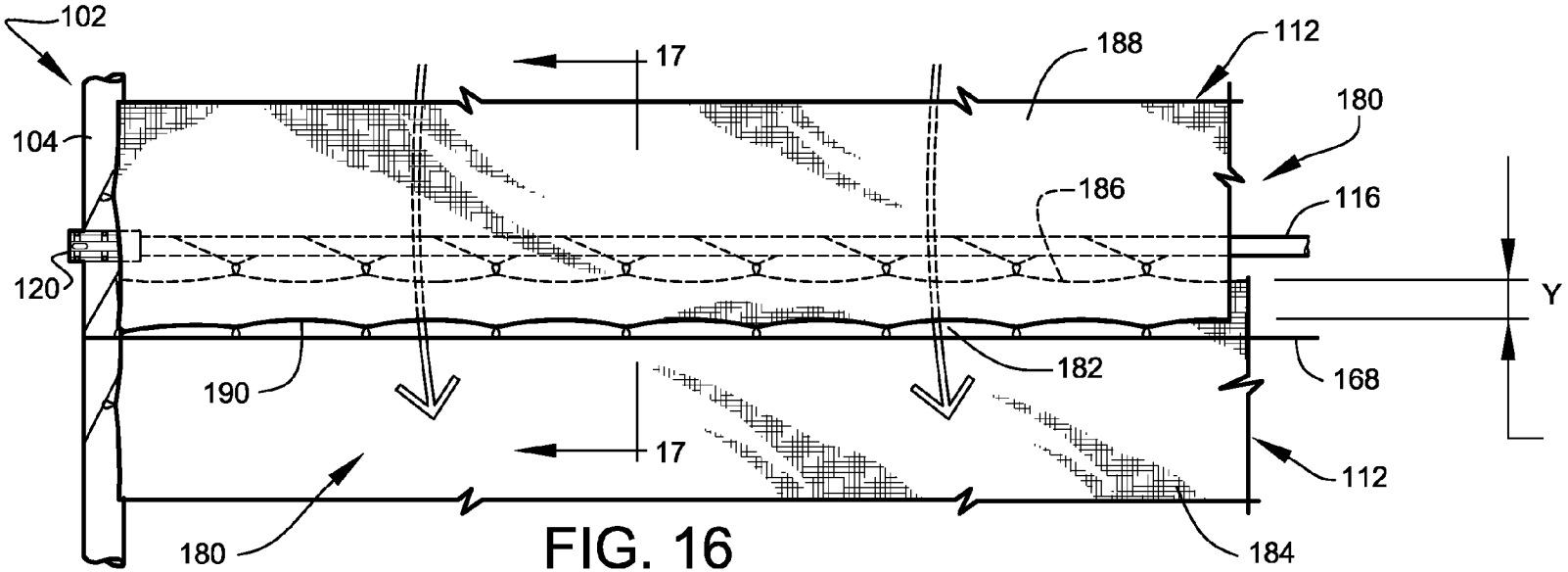
FIG. 16 shows a top view of a preferred wind-relieving application of the shade fabric to the supporting structures of the arch-type shade module.
Figure 17:
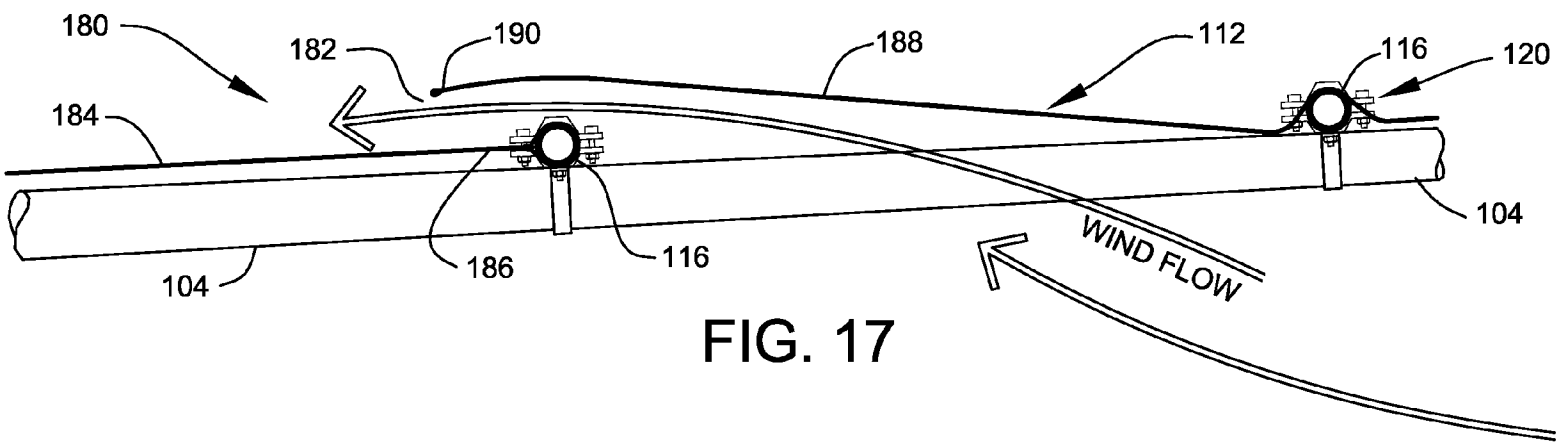
FIG. 17 shows a sectional view through the section 17-17 of FIG. 16 illustrating the wind-relieving feature of the installation of FIG. 16.

FIG. 16 shows a top view of a preferred wind-relieving arrangement 180 of flexible shade material 112 mounted to the supporting structures of arch-type shade module 102. FIG. 17 shows a sectional view through the section 17-17 of FIG. 16 illustrating the wind-relieving feature of the installation of FIG. 16.

Flexible shade material 112 will characteristically experience variable levels of wind loading during operational service. Wind moving at right angles to the upper leading secondary support member 116 naturally reacts with the undersurfaces of flexible shade material 112, particularly in the region of radius R1 (see FIG. 2). In most situations, the robust structure of shade system 100 resists wind-generated force loads without damage. Under severe wind loads, momentary wind gusts can potentially exceed the design limits of the system. To address this issue, shade system 100 preferably comprises a number of unique features adapted to reduce dynamic wind forces imposed on the structure of arch-type shade module 102.

Preferably, flexible shade material 112 is applied to the supporting structures of arch-type shade module 102 in an arrangement providing one or more wind-relieving passages 182, as shown. Preferably, wind-relieving arrangement 180 comprises a first fabric panel 184 having a first peripheral edge 186 (at least embodying herein at least one first flexible shade element having at least one first peripheral portion) spiral laced to one of the rigid secondary support members 116 (at least embodying herein at least one first bar supported within such at least one shading structure in a first position), as shown. Preferably, a second fabric panel 188 having a second peripheral edge 190 (at least embodying herein at least one second flexible shade element having at least one second peripheral portion) is attached to arch-type shade module 102 in a position overlaying first peripheral edge 186 of first fabric panel 184, as shown. Preferably, second peripheral edge 190 is secured using the cable-supported arrangement of FIG. 13, as shown (at least embodying herein at least one second bar supported within such at least one shading structure in a second position substantially parallel to such first position). Preferably, second peripheral edge 190 overlays first peripheral edge 186 a distance Y, as shown. Distance Y is at least sufficient to provide continuous shade protection across the two flexible fabric panels, as shown.

Under small to moderate wind loads, second peripheral edge 190 is held tightly adjacent the upper surface of first fabric panel 184 by the tension of flexible cable 168. Under high wind loads, forces applied to the under-surface of second fabric panel 188 are transferred to flexible cable 168 resulting in a momentary elastic deformation of the cable. Preferably, elongation of flexible cable 168 under the tensile load results in an upward deflection of second peripheral edge 190, as shown (bending such at least one flexible shade support). Preferably, the upward deflection of second peripheral edge 190 creates wind-relieving passage 182 that preferably allows the wind to pass through the shade structure, essentially without restriction, as indicated by the arrow depiction. In the absence of significant wind loading, flexible cable 168 returns to a pre-loaded state that preferably draws second peripheral edge 190 to its former position held tightly adjacent the upper surface of first fabric panel 184.

The above-described arrangements at least embody herein wherein such wind relief system is structured and arranged such that air flow into such first and second flexible shade elements bends such at least one flexible shade support to open air space between such at least one first peripheral portion and such at least one second peripheral portion; and wherein air may non-destructively flow through such at least one shading structure. It is noted that one may preferably make multiple attachment points and may utilize multiple secondary support members 116, both above and below the primary support members 104, to preferably produce a series of wind-relieving passages 182. In other words, one may preferably provide a wind-relieving passage 182 adjacent every secondary support member 116, after the first wind-relieving passage 182, going down the system like "shark's gills".

Figure 18:
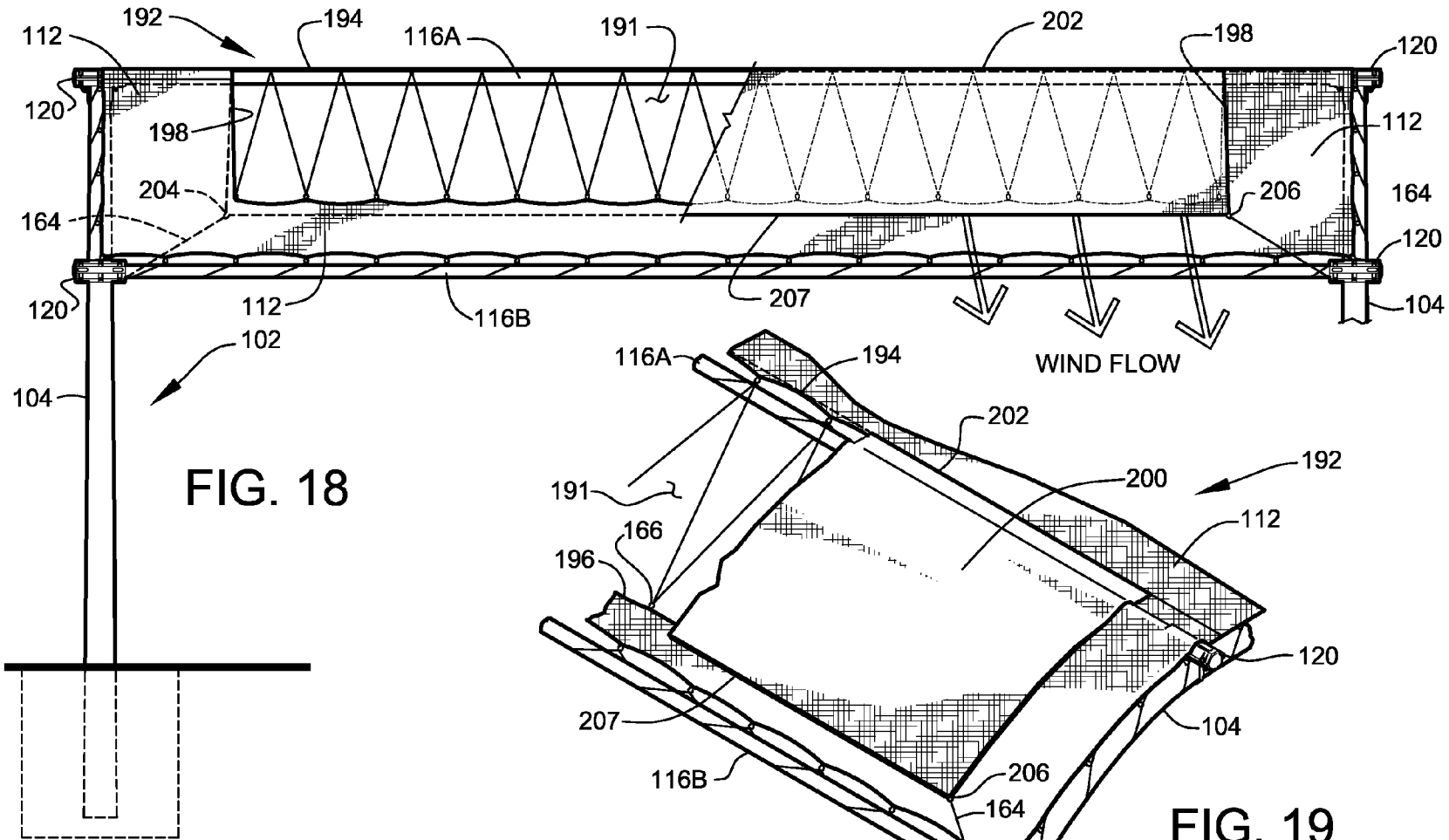
FIG. 18 shows a rear view of a wind-relief port comprising another wind-relieving feature of the arch-type shade module.
Figure 19:
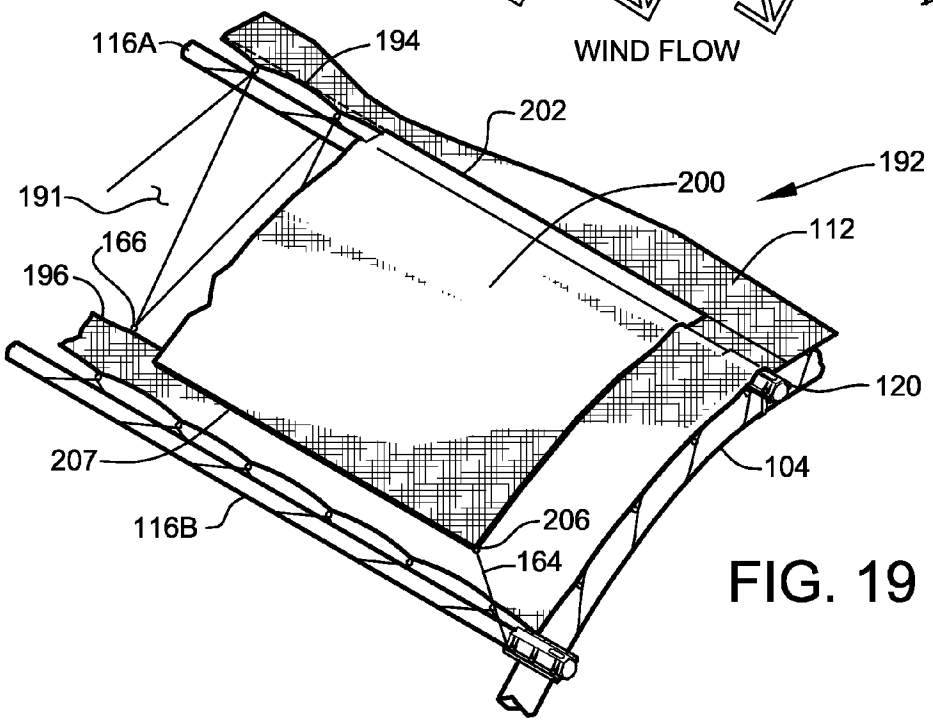
FIG. 19 shows a perspective view of the wind-relief port of FIG. 18.

FIG. 18 shows a rear view of wind-relief port 192 comprising an alternate preferred wind-relieving feature used within arch-type shade module 102. FIG. 19 shows a perspective view of wind-relief port 192 of FIG. 18. Wind-relief port 192 preferably provides an alternate means for reducing wind loads within the structure of arch-type shade module 102 by diverting a portion of the wind, coming into contact with flexible shade material 112, through a purposefully-designed rear opening, as shown.

Preferably, wind-relief port 192 comprises an aperture opening 191 formed within flexible shade material 112, as shown. In most preferred embodiments of arch-type shade module 102, wind-relief port 192 is located within generally vertical portions of the fabric shade panels, as shown. For example, wind-relief port 192, as depicted in FIG. 18 and FIG. 19, is preferably located in the area of radius R1, within the portion of flexible shade material 112 spanning between the two primary support members 104, upper secondary support member 116A (at least embodying herein at least one first bar supported within such at least one shading structure), and lower secondary support member 116B (at least embodying herein at least one second bar supported within such at least one shading structure), as shown.

Preferably, wind-relief port 192 comprises a generally elongated rectangular opening having an upper interior edge 194 lower interior edge 196 (at least embodying herein one first peripheral portion), and opposing side interior edges 198, as shown. Preferably, lower interior edge 196 comprises a plurality of looped eyelets 166 comprising a construction substantially similar to the edge construction described in FIG. 14. Preferably, lower interior edge 196 is spiral laced to upper secondary support members 116A, as shown (at least embodying herein at least one first connection connecting such at least one first peripheral portion to such at least one first bar). Preferably, a fabric cover panel 200 is attached to flexible shade material 112 in a position overlaying wind-relief port 192, as shown. Preferably, cover panel 200 (at least embodying herein at least one second flexible shade element) comprises a shape generally matching that of aperture opening 191, most preferably an elongated rectangle, as shown. Preferably, upper peripheral edge 202 of cover panel 200 is firmly secured to flexible shade material 112 along upper interior edge 194, most preferably by sewing, preferably using an appropriate thread, as shown. Preferably, peripheral edge 207 (at least embodying herein a second peripheral portion) comprises lower corner 204 and lower corner 206, as shown. Preferably, lower corner 204 and lower corner 206 of cover panel 200 are lashed to the support structure of arch-type shade module 102 using flexible cord 164, as shown (at least embodying herein a plurality of flexible restraints respectively connecting each of such at least two end portions with such at least one second bar).

Under small to moderate wind loads, the underside of cover panel 200 is held tightly against the upper surface of flexible shade material 112 by the tension of flexible cord 164. Under high wind loads, forces applied to the under-surface of cover panel 200 are transferred to flexible cord 164 and the fabric of cover panel 200 resulting in a momentary elastic deformation of cover panel 200. Preferably, such loading results in an upward deflection of peripheral edge 207 of cover panel 200, as shown. Preferably, the upward deflection of cover panel 200 allows a portion of the wind to pass through aperture opening 191 without applying significant loads to the shade structure, as generally indicated by the arrow depiction. In the absence of significant wind loading, the materials of cover panel 200 return to a pre-loaded state effectively covering aperture opening 191.

Figure 57:
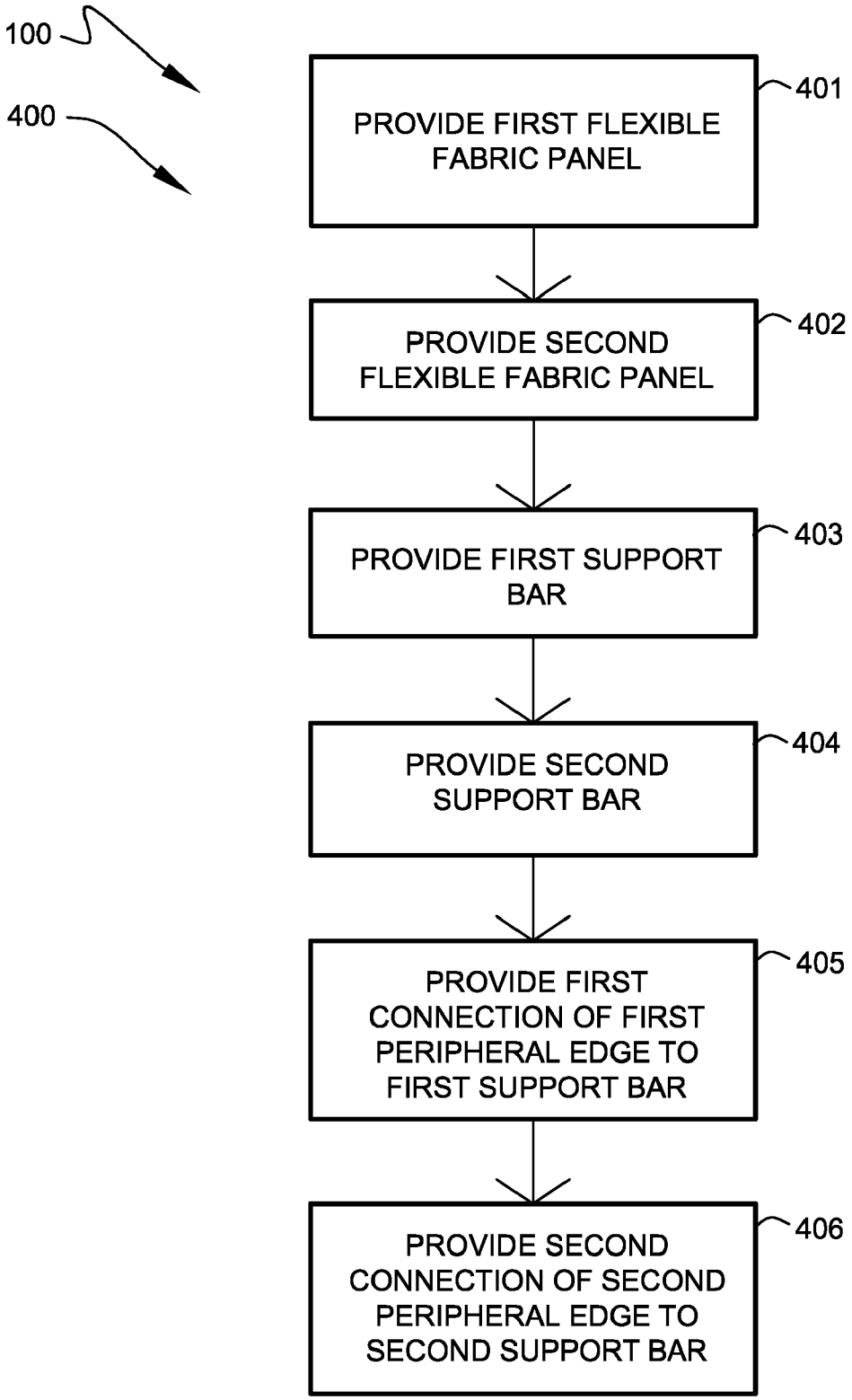
FIG. 57 shows a diagram describing a preferred method of developing a preferred wind-relief feature, within the arch-type shade module, according to a preferred embodiment of the present invention.

As shown in FIG. 16 through FIG. 19 and with specific reference to the diagram of FIG. 57, shade system 100 preferably comprises method 400, comprising the preferred steps of: (401) providing at least one first fabric panel 184 having at least one first peripheral edge 186, such first fabric panel 184 comprising flexible shade material 112; (402) providing at least one second fabric panel 188 having at least one second peripheral edge 190 such second fabric panel 188 comprising flexible shade material 112; (403) providing at least one first bar, supported within at least one shading structure in a first position; (404) providing at least one second bar, preferably supported within such at least one shading structure in a second position substantially parallel to such first position; (405) providing at least one first connection connecting first peripheral edge 186 to such at least one first bar; and (406) providing at least one second connection connecting second peripheral edge 190 to such at least one second bar; wherein at least one of such first and second bars comprises flexible cable 168; and wherein at least one of such first and second bars comprises secondary support member 116; wherein such wind relief system is structured and arranged such that air flow into first fabric panel 184 and second fabric panel 188 bends flexible shade material 112 to open an air passage between first peripheral edge 186 and second peripheral edge 190; and wherein air may non-destructively flow through such at least one shading structure.

Method 400 preferably provides within shade system 100 an arrangement that minimizes the load applied to shade elements during windy weather conditions, so as to prevent the shading system from damage to the pressure of air across the broad, impermeable projected surface area of a shade element. As previously noted, it is critical that shade system 100 remain in sound condition in the face of strong winds, in order for compliance with traditional municipal codes and regulations.

Figure 20:
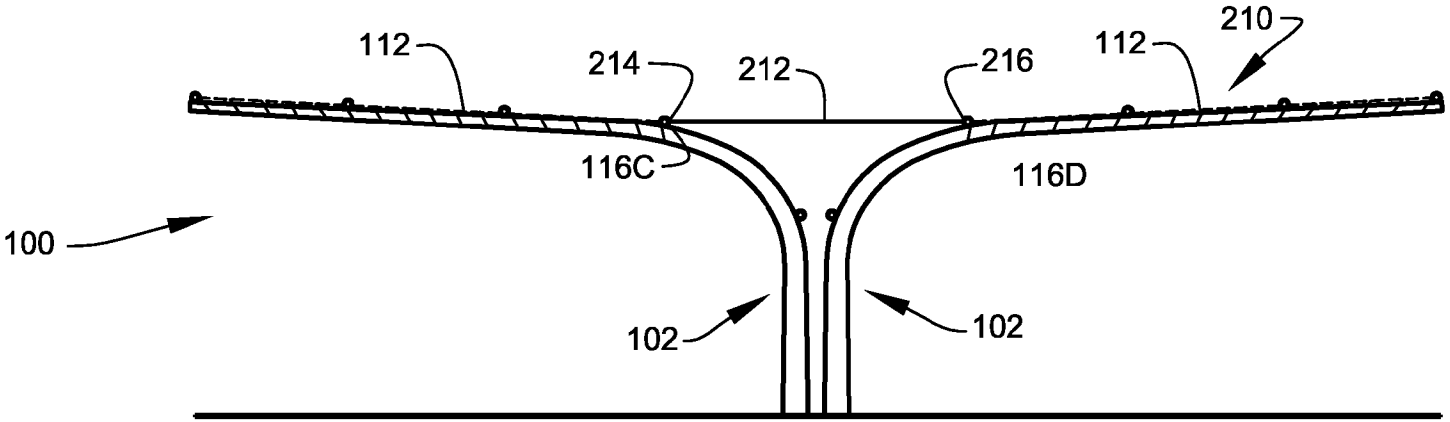
FIG. 20 shows a side view of a back-to-back shade structure, comprising the arch-type shade modules of FIG. 1, according to a preferred embodiment of the present invention.

FIG. 20 shows a side view of back-to-back shade structure 210, comprising two arch-type shade modules 102, according to a preferred embodiment of the present invention. Preferably, a number of alternate preferred shade configurations are produced by the adjacent arrangement of multiple arch-type shade modules 102, as illustrated in FIG. 20 and FIG. 21.

Preferably, back-to-back shade structure 210 comprises a common span of flexible shade material 112 identified herein as linking panel 212. Preferably, linking panel 212 spans from secondary support member 116C of the first arch-type shade module 102 to secondary support member 116D of the second arch-type shade module 102, as shown. Preferably, to allow for minor variations of distance between the two structures, edge 214 of linking panel 212 (running parallel and adjacent to secondary support member 116C) is sewn to the larger fabric panel while edge 216 (extending substantially parallel and adjacent to secondary support member 116D) is laced to secondary support member 116D, as shown. Upon reading the teachings of this specification, those of ordinary skill in the art will now understand that, under appropriate circumstances, considering such issues as intended use, length of span, etc., other arrangements, such as, using a single uninterrupted length of fabric, adding rigid support members, etc., may suffice. Back-to-back shade structure 210 of FIG. 20 is especially useful in shading multi-vehicle parking areas, as shown.

Figure 21:
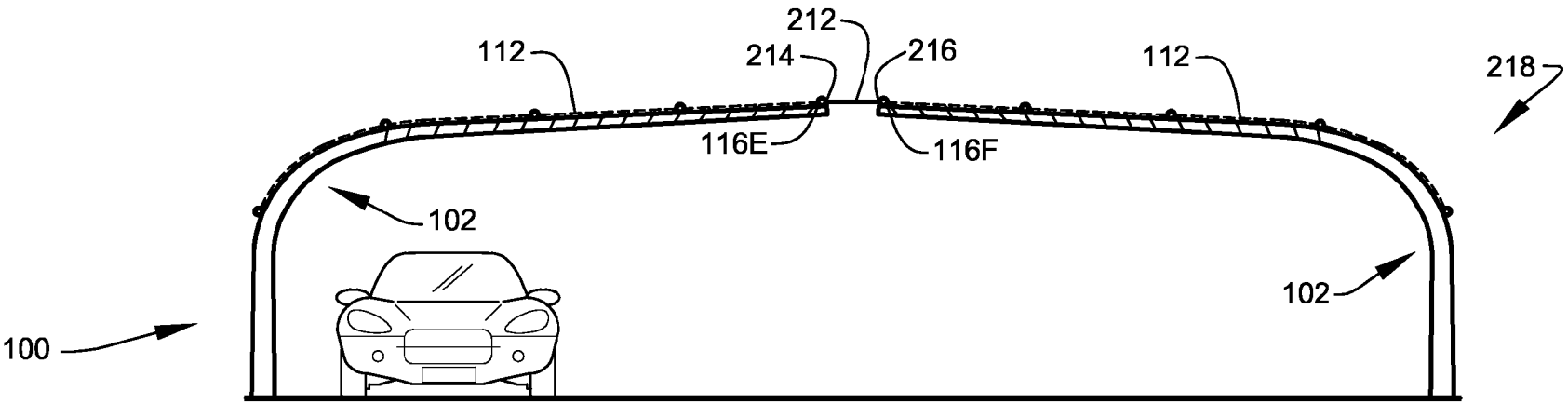
FIG. 21 shows a side view of a tunnel shade structure, comprising the arch-type shade modules of FIG. 1, according to a preferred embodiment of the present invention.

FIG. 21 shows a side view of tunnel shade structure 218, comprising arch-type shade modules 102, according to a preferred embodiment of the present invention. Preferably, tunnel shade structure 218 similarly comprises a common linking panel 212, as shown. Preferably, linking panel 212 spans from secondary support member 116E of the first arch-type shade module 102 to secondary support member 116F of the second arch-type shade module 102, as shown. Edge 214 of linking panel 212 (running parallel and adjacent to secondary support member 116E) is preferably sewn to the larger fabric panel while edge 216 (extending substantially parallel and adjacent to secondary support member 116F) is laced to secondary support member 116F, as shown. Upon reading the teachings of this specification, those of ordinary skill in the art will now understand that, under appropriate circumstances, considering such issues as intended use, length of span, etc., other arrangements, such as, using a single uninterrupted length of fabric, utilizing additional rigid support members, etc., may suffice.

Figure 22:
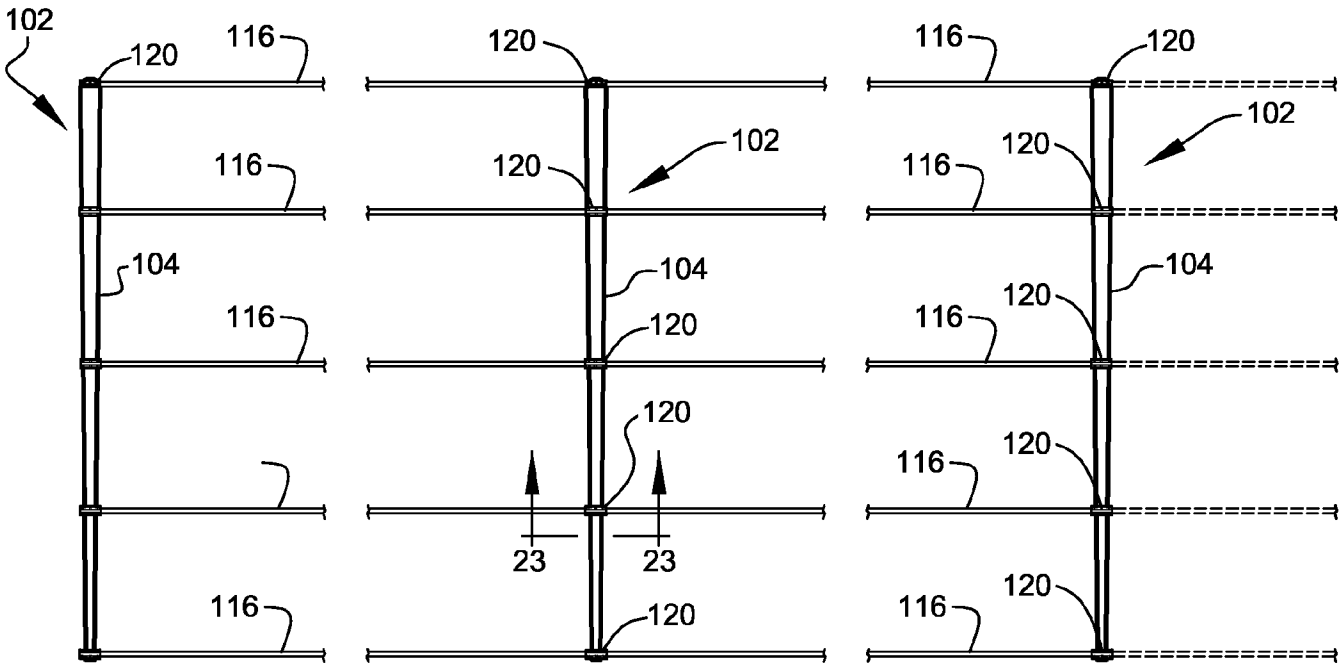
FIG. 22 shows a top view of a linear shade structure, comprising a continuous assembly of the arch-type shade modules of FIG. 1, according to a preferred embodiment of the present invention.
Figure 23:
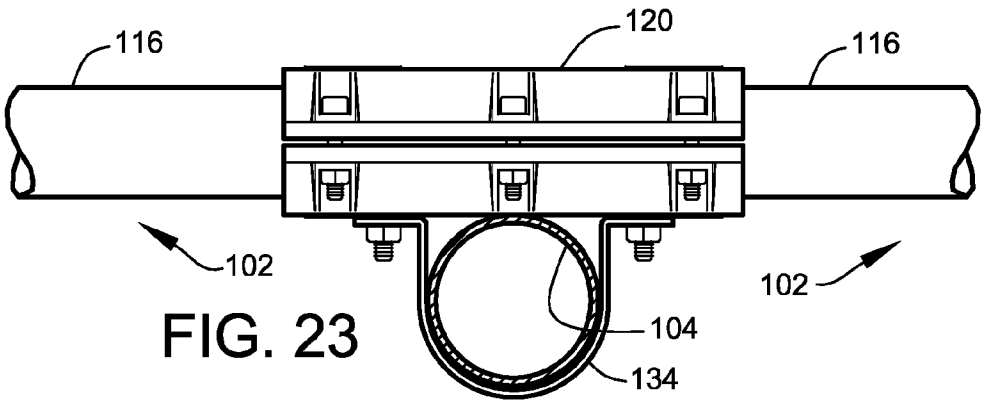
FIG. 23 shows the sectional view 23-23 of FIG. 22.

FIG. 22 shows a top view of linear shade structure 220, comprising a continuous assembly of arch-type shade modules 102, according to a preferred embodiment of the present invention. FIG. 23 shows the sectional view 23-23 of FIG. 22. Preferably, a plurality of arch-type shade modules 102 can be interconnected to form a single linear shade structure of essentially any length, as shown. Preferably, each primary support member 104 (excluding the end supports) is adapted to support two adjoining sets of secondary support members 116, as shown. Preferably, each adjoining set of secondary support members 116 is firmly retained in transverse coupler assemblies 120, as best illustrated in the sectional view of FIG. 23.

Figure 25:
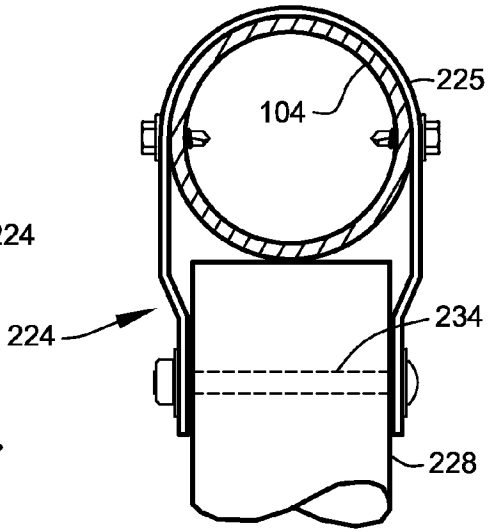
FIG. 25 shows a sectional view through the section 25-25 of FIG. 24 illustrating a pivot coupler of the cantilever support system of FIG. 24.
Figure 26:
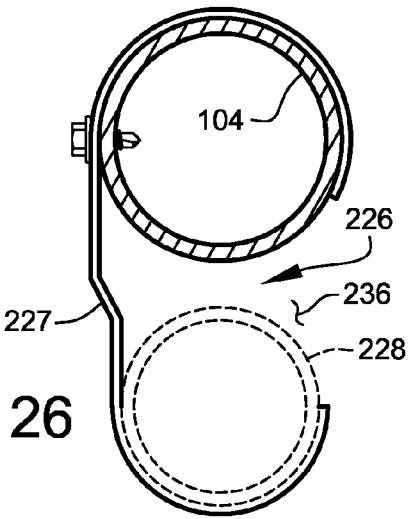
FIG. 26 shows a sectional view through the section 26-26 of FIG. 24 illustrating a pivot retainer of the cantilever support system of FIG. 24.
Figure 24:
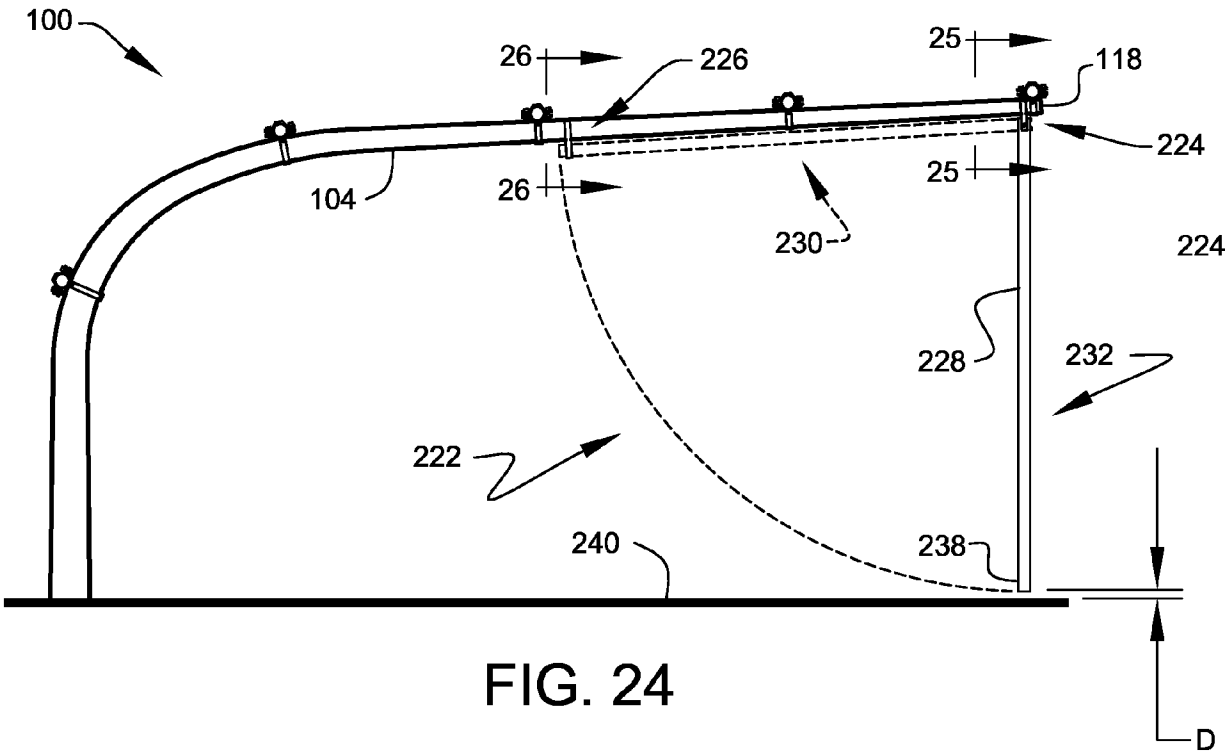
FIG. 24 shows a side view illustrating a deployable cantilever support system adapted to provide additional structural support to the primary support member.

FIG. 24 shows a side view illustrating deployable cantilever support system 222 adapted to provide additional structural support to primary support member 104. FIG. 25 shows a sectional view through the section 25-25 of FIG. 24 illustrating pivot coupler 224 of cantilever support system 222. FIG. 26 shows a sectional view through the section 26-26 of FIG. 24 illustrating pivot retainer 226 of cantilever support system 222.

Preferably, deployable cantilever support system 222 (at least embodying herein at least one vertical support system) is principally used in geographic regions receiving heavy snowfall. Preferably, deployable cantilever support system 222 comprises support column 228 pivotally mounted to end terminations 118 (at least embodying herein at least one extending end portion) of primary support member 104 (at least embodying herein at least one substantially vertical pole and at least one cantilever bar element, having at least one inner end portion and at least one extending end portion) using pivot coupler 224, as shown. Preferably, support column 228 is adapted to deploy from a substantially horizontal stowed position 230 to the depicted "operable" position 232 that provides additional structural support near the end terminations 118 of each primary support member 104, as shown.

Preferably, pivot coupler 224 comprises a U-shaped strap 225 rigidly mounted to primary support member 104, as shown. Preferably, support column 228 is pivotally retained within pivot coupler 224 using pivot pin 234, as shown. Preferably, pivot pin 234 passes through apertures located within the end of pivot coupler 224 and support column 228, as shown.

Preferably, pivot retainer 226 comprises a substantially rigid strap 227 firmly coupled to primary support member 104, as shown. Pivot retainer 226 is preferably adapted to maintain support column 228 adjacent the underside of cantilevered portion 110, as shown. Preferably, gap opening 236 of pivot retainer 226 is of sufficient width to allow support column 228 to be slipped from the supported position within pivot retainer 226 during deployment of the support (at least embodying herein at least one deployment assistance).

During periods when heavy snowfall is anticipated, cantilever support system 222, may be manually deployed preferably by moving support column 228 out of pivot retainer 226 to allow support column 228 to swing into the depicted vertical position of FIG. 24 (at least embodying herein at least one vertical support member structured and arranged to support by supportive contact with at least one adjacent ground surface). Note that support column 228 is preferably sized such that the lower end 238 hangs above ground surface 240 a distance D of preferably about 20 centimeters. This assures that support column 228 can be deployed, even after some loading of the structure has begun (at least embodying herein wherein the vertical deployed length of such at least one vertical support is less than the vertical distance between such at least one extending end portion, at about the location of such at least one pivot coupler, and the at least one adjacent ground surface). As the shade structure deflects under the weight of the snow, lower end 238 eventually touches ground surface 240 and begins to contribute to the support of the structure. Preferably, support column 228 comprises a metallic tube preferably having an outer diameter of at least 48 millimeters and a wall thickness of about two millimeters.

After the snow load has been removed from the system, cantilever support system 222 can again be placed in the stowed position 230 adjacent cantilevered portion 110. This highly preferred system allows for the development of longer and lighter cantilever structures than would normally be developed in cold geographical regions. Upon reading the teachings of this specification, those of ordinary skill in the art will now understand that, under appropriate circumstances, considering such issues as intended use, local codes, cost, etc., other support column deployment arrangements, such as on umbrella cantilevers and such systems where snow conditions warrant additional vertical support (even without the "too short" initial support length), and such as using fully automatic deployment systems, wireless deployment systems, active deployment systems operating by the detection of local site conditions, active deployment systems operating on receiving remote weather data, passive deployment systems operating on a predetermined deflection condition within the shade support structure, etc., may suffice.

Figure 27:
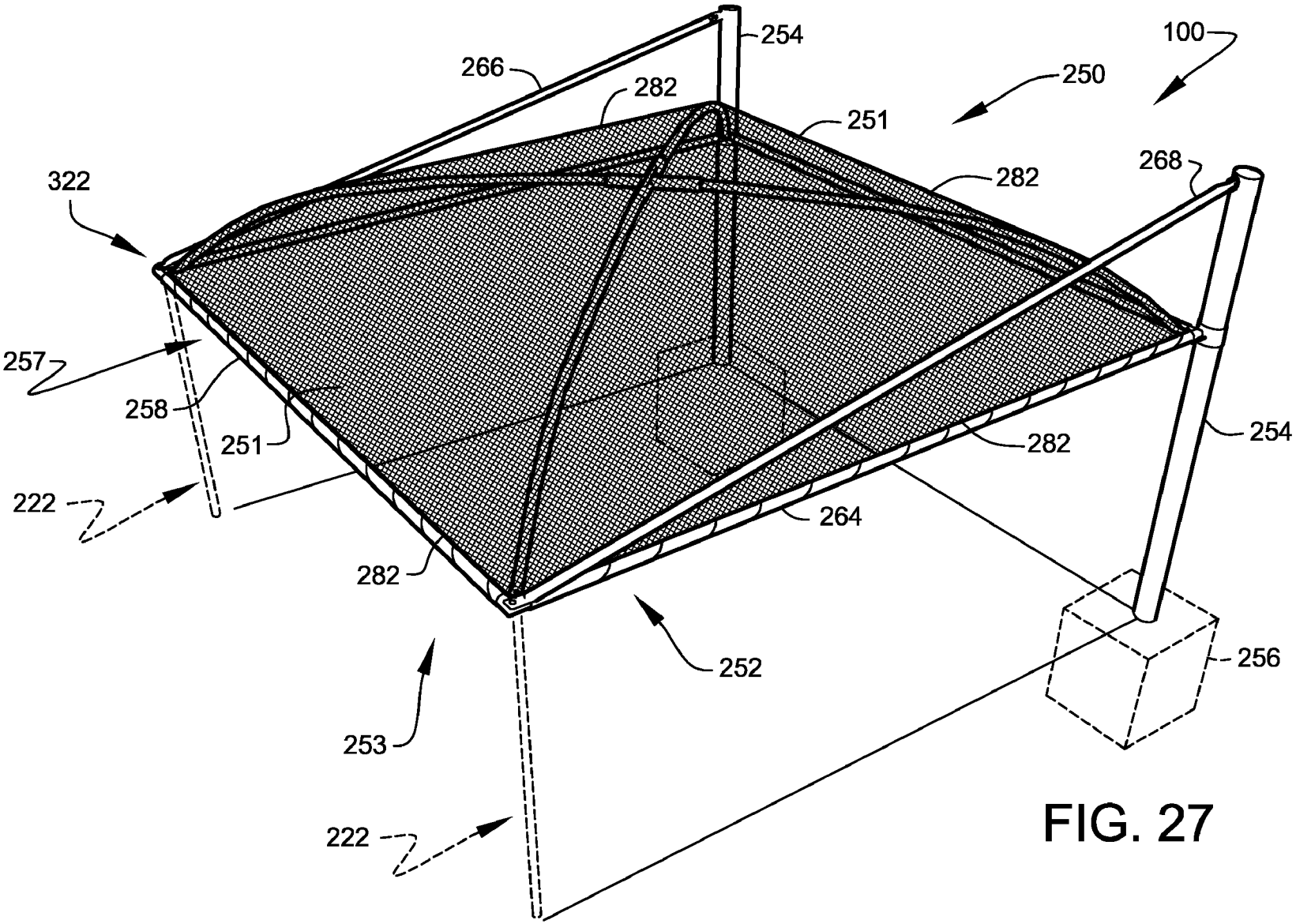
FIG. 27 shows a perspective view illustrating an umbrella-type shade module of the adaptable shade system according to a preferred embodiment of the present invention.
Figure 28:
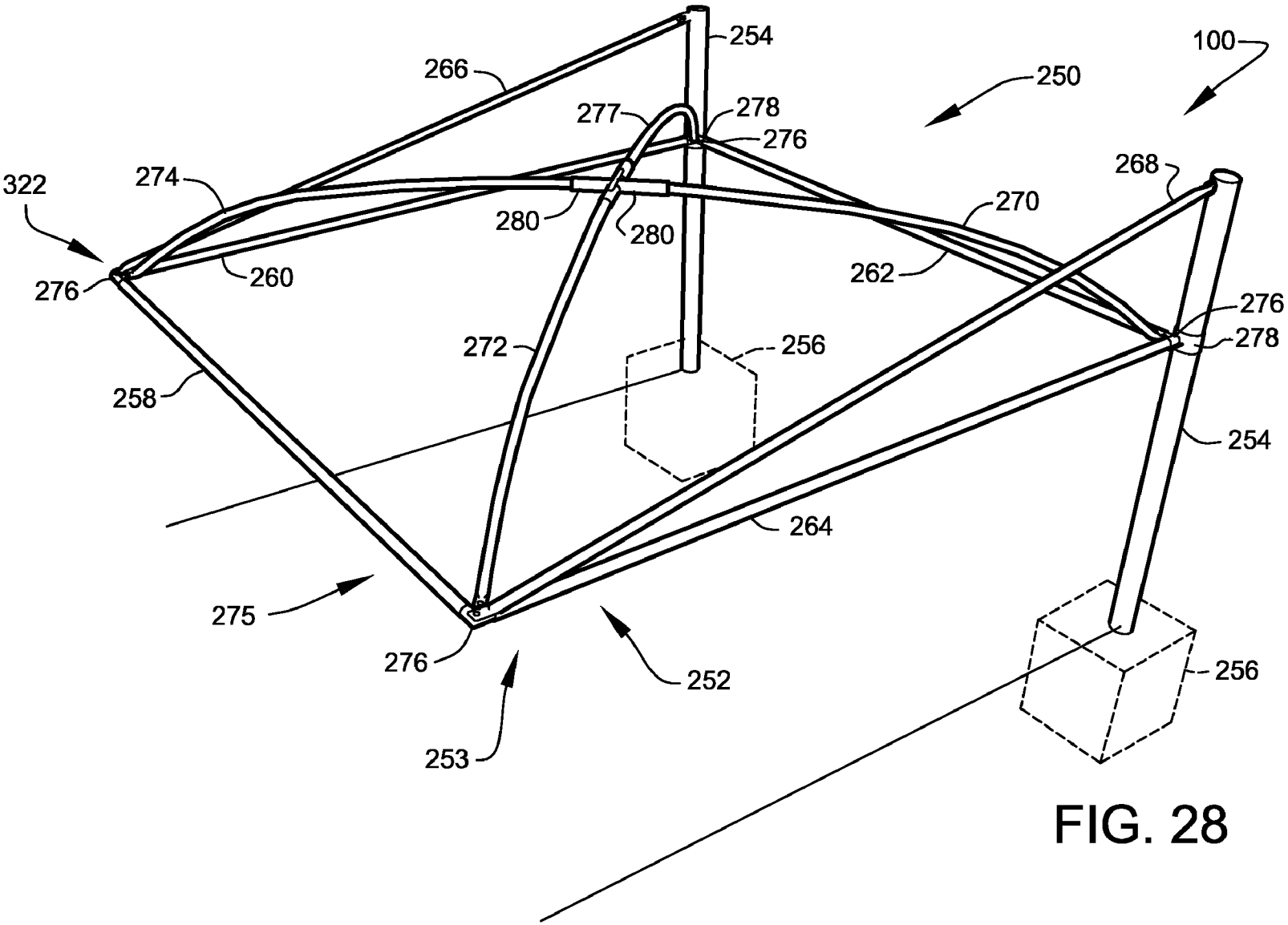
FIG. 28 shows a perspective view illustrating the structural framework of the umbrella-type shade module of FIG. 26.
Figure 29:
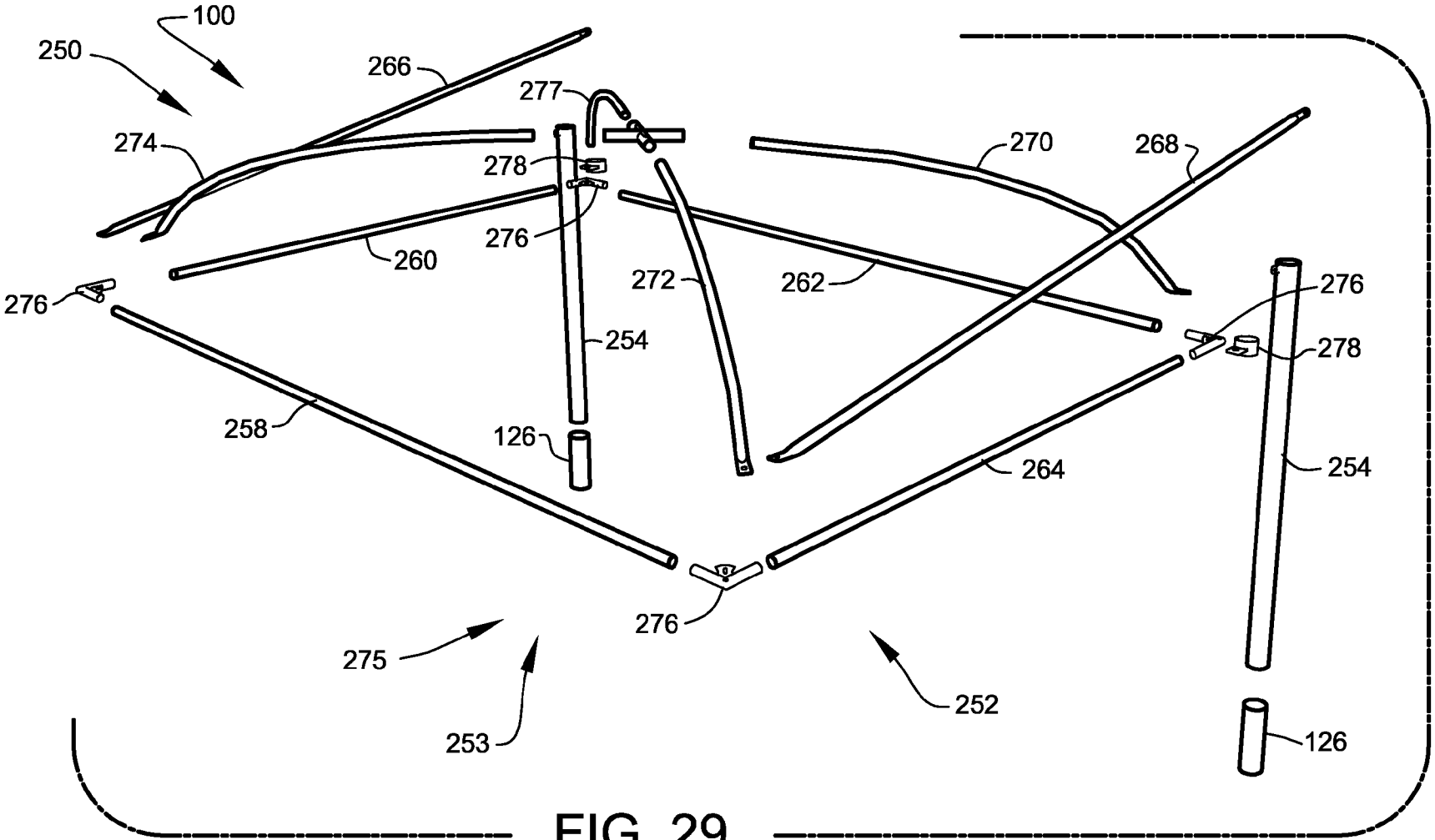
FIG. 29 shows an exploded view illustrating structural components of the structural framework of FIG. 28.

FIG. 27 shows a perspective view illustrating umbrella-type shade module 250 of adaptable shade system 100 according to a preferred embodiment of the present invention. FIG. 28 shows a perspective view illustrating structural frame 252 of umbrella-type shade module 250 of FIG. 26. FIG. 29 shows an exploded view illustrating structural components of structural frame 252 of FIG. 28. Umbrella-type shade module 250 preferably comprises a preferred embodiment of the closely related cantilevered shade structures of shade system 100.

As with the prior-described system embodiments, umbrella-type shade module 250 is adaptable to serve as exterior protection for land vehicles, boats, and other valuable assets. Preferably, umbrella-type shade module 250 is effective in protecting against solar damage, bird-waste, and hail. Umbrella-type shade module 250 is further adaptable to extend the usability of exterior spaces including loading docks, patio spaces, and pool decks. Preferably, umbrella-type shade module 250 is effective in slowing the wear and tear of paving materials and, when equipped with deployable cantilever support system 222, provides a level of protection from snowfall unique to cantilevered shade structures.

Preferably, each umbrella-type shade module 250 comprises flexible umbrella shade element 257, as shown. Preferably, flexible umbrella shade element 257 comprises a panel of flexible shade material 251 supported by a rigid structural frame 252, as shown. Preferably, the inner corners of flexible umbrella shade element 257 (of a single module) are supported on two vertical columns identified herein as primary support members 254, as shown. Preferably, each primary support member 254 comprises two ends with the lower end projecting upwardly from a preferred engagement with foundation structure 256, as shown. As with arch-type shade module 102, primary support members 254 (at least embodying herein a plurality of substantially vertical pole structures, each such vertical pole structure comprising at least one first pole end-portion and at least one second pole end-portion) of umbrella-type shade module 250 are removeably mounted within foundation structure 256, by embedment within a sand-packed sleeve 124 (see FIG. 2 for similar foundation mounting arrangements).

Preferably, each primary support member 254 comprises a substantially circular cross section, preferably a substantially uniform cross section having a preferred diameter of about 160 millimeters and a wall thickness of about four millimeters. Preferably, the tops of each primary support member 254 is capped to prevent rain water or other from entering the structural element.

Preferably, the interspacing of the primary support members 254 establishes the width of a single module and most preferably comprises a center-to-center distance of about five meters. The preferred overall dimensions of umbrella-type shade module 250 are about five meters by about five meters with a clear height of just over about two meters.

The cantilevered extension of flexible umbrella shade element 257 preferably comprises a group of elongated circular pipes assembled using a unique selection of adjustable pipe couplers, as shown. This preferred grouping of cantilevered support members include first horizontal segment 258, second horizontal segment 260, third horizontal segment 262, fourth horizontal segment 264, first curved support 270, second curved support 272, third curved support 274, and fourth curved support 277, as shown. Preferably, the outer corners of flexible umbrella shade element 257 are preferably supported from primary support member 254 by first upper diagonal member 266 and second upper diagonal member 268, as shown. Preferably, each elongated circular pipe of the cantilevered extension of structural frame 252 comprises a preferred diameter of about 60 millimeters and a preferred wall thickness about two and one half millimeters.

Preferably, four adjustable corner couplers 276 interconnect first horizontal segment 258, second horizontal segment 260, third horizontal segment 262, and fourth horizontal segment 264 to form a substantially horizontal parallelogram (preferably a rectangle having four umbrella corners) identified herein as peripheral frame 275, as shown. Preferably, adjustable couplers 278 (at least embodying herein at least one vertically-adjustable sleeve members) support the two proximal corner couplers 276 of peripheral frame 275 from primary support members 254, as shown. Preferably, each adjustable coupler 278 is adjustably mounted to the outer circumferential surface of its respective primary support member 254, as shown. Thus, the above-described preferred arrangement facilitates assembly of the system by providing sufficient levels of adjustment to overcome geometrical inconsistencies.

Preferably, the two distal corner couplers 276 of peripheral frame 275 are supported from primary support members 254 by first upper diagonal member 266 and second upper diagonal member 268, as shown. Preferably, each upper diagonal member extends from a respective corner coupler to near the upper termination of its respective primary support member 254, as shown (at least embodying herein a plurality of cantilever bar elements each respectively supported by and extending from such plurality of substantially vertical pole structures).

Preferably, first curved support 270, second curved support 272, third curved support 274, and fourth curved support 277 (each at least embodying herein at least one corner pole element) are interconnected by a single scissor-type coupler 280, as shown. The resulting X-shaped assemblage preferably forms a preferred concave surface within flexible shade material 251, as best shown in FIG. 27. Preferably, each free end of the assemblage is coupled to a respective corner coupler 276 (at least embodying herein such at least one first second and third connectors), as shown.

Preferably, flexible shade material 251 comprises a single fabric panel forming a parallelogram having a physical size generally matching that of peripheral frame 275, as shown. Preferably, the four peripheral edges 282 of flexible shade material 251 comprise the loop-forming construction of FIG. 14. Preferably, flexible shade material 251 is spiral laced to peripheral frame 275, in a manner substantially similar to the illustration of FIG. 12. As with the prior embodiments of shade system 100, flexible shade material 112 is preferably selected from materials providing environmental protection, most preferably solar protection through the control of ultraviolet (UVA-UVB) radiation levels. Preferably, the surface of flexible shade material 251 is "post-tensioned", after lacing, using a unique installation method further described in FIG. 56.

Preferably, in regions experiencing heavy snow loads, umbrella-type shade module 250 may comprise deployable cantilever support system 222, as indicated by the dashed-line depiction of FIG. 27. Upon reading the teachings of this specification, those of ordinary skill in the art will now understand that, under appropriate circumstances, considering such issues as intended use, local codes, cost, etc., other deployable cantilever support system arrangements, such as utilizing deployable cantilever support columns without the "too short" initial support length, and such as using fully automatic deployment systems, wireless deployment systems, active deployment systems operating by the detection of local site conditions, active deployment systems operating on receiving remote weather data, passive deployment systems operating on a predetermined deflection condition within the shade support structure, etc., may suffice.

Figure 31:
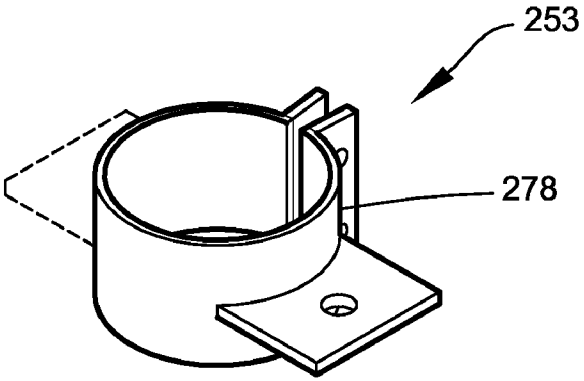
FIG. 31 shows a perspective view of an adjustable coupler of the umbrella-type shade module of FIG. 26.
Figure 33:
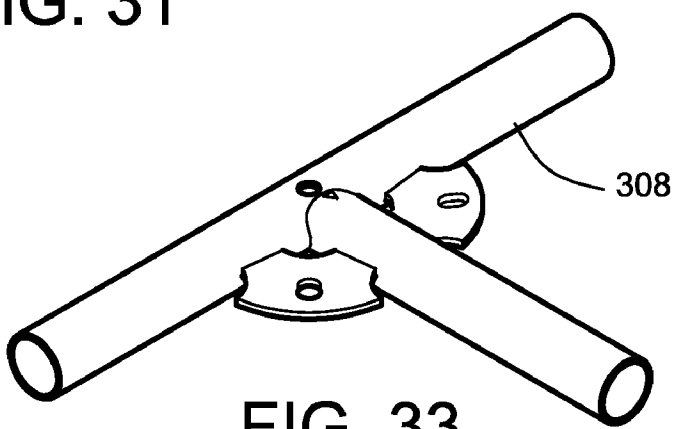
FIG. 33 shows a perspective view of a T-type coupler of the umbrella-type shade module of FIG. 26.
Figure 32:
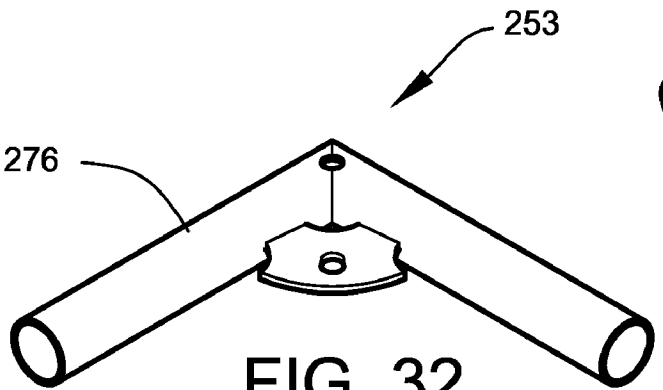
FIG. 32 shows a perspective view of a corner coupler of the umbrella-type shade module of FIG. 26.
Figure 30:
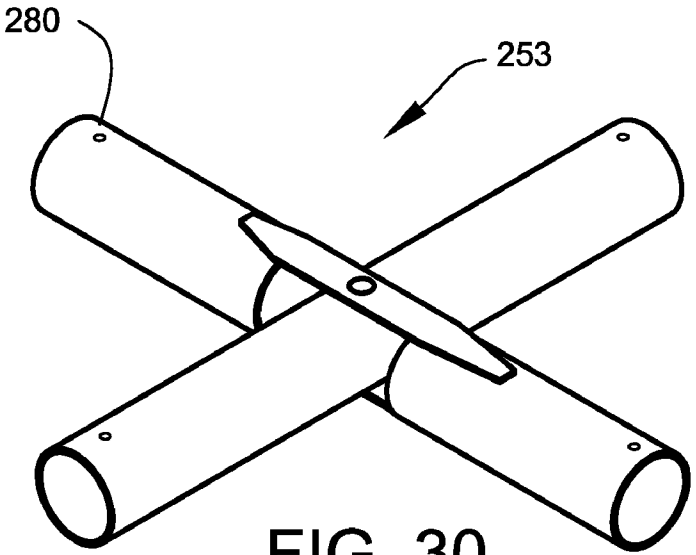
FIG. 30 shows a perspective view of a scissor-type coupler of the umbrella-type shade module of FIG. 26.

FIG. 30 shows a perspective view of scissor-type coupler 280 of umbrella-type shade module 250 of FIG. 26. FIG. 31 shows a perspective view of adjustable coupler 278 of umbrella-type shade module 250 of FIG. 26. FIG. 32 shows a perspective view of corner coupler 276 of the umbrella-type shade module of FIG. 26. FIG. 33 shows a perspective view of a special T-type coupler 308 of the umbrella-type shade module 250.

Figure 34:
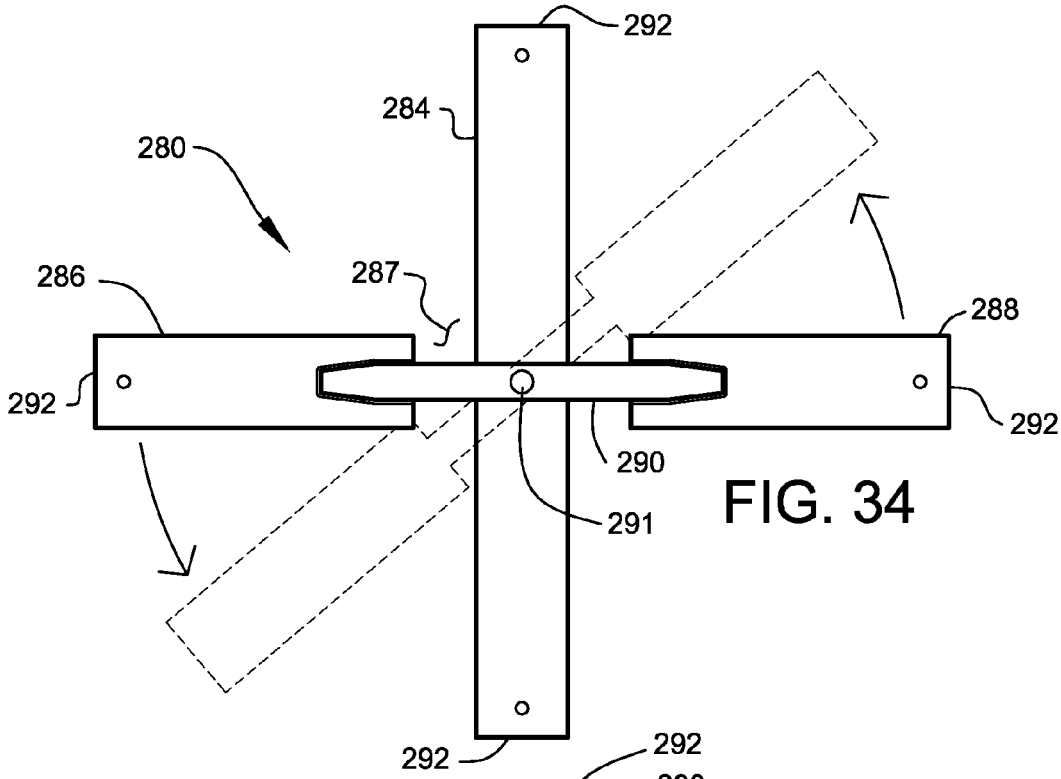
FIG. 34 shows a top view of the scissor-type coupler of FIG. 30.
Figure 35:
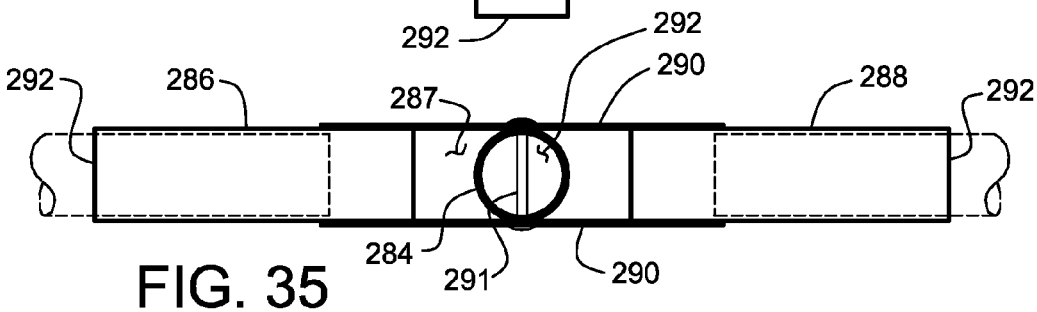
FIG. 35 shows a side view of the scissor-type coupler of FIG. 30.

FIG. 30 through FIG. 33 illustrate components of a preferred adjustable coupler system 253 (at least embodying herein wherein such at least one adjustable support system comprises a plurality of support devices structured and arranged to assist adjustable setup and strengthening of such cantilever-supported-umbrella shade system) used to assemble the structural framework of umbrella-type shade module 250. The following descriptions discuss, in greater detail, specific structures and arrangements of the adjustable couplers comprising coupler system 253. FIG. 34 shows a top view of an adjustable scissor-type coupler 280 of FIG. 30. FIG. 35 shows a side view of scissor-type coupler 280. Preferably, scissor-type coupler 280 (at least embodying herein at least one apex connector) comprises connector tube 284, connector tube 286, connector tube 288, and a pair of linking plates 290, as shown. Preferably, two linking plates 290 are used to permanently coupled connector tube 286 to connector tube 288 in a substantially coaxial orientation, as shown. Preferably, the ends of linking plates 290 are located at 180-degree positions along the outer circumference of connector tube 286 and connector tube 288 and are permanently attach, preferably using thermal welding. Connector tube 286 is preferably spaced from connector tube 288 to form gap 287 through which connector tube 284 is passed. Preferably, connector tube 284 is pivotally coupled to linking plates 290 by a transverse pivot pin 291, as best shown in FIG. 34 and FIG. 35. Preferably, pivot pin 291 extends from the upper linking plate 290, through connector tube 284 to intersect the lower linking plate 290, as shown. Preferably, the ends of pivot pin 291 are permanently joined to linking plates 290 with thermal welding being the preferred method of joining. With this preferred construction, the rotational orientation of connector tube 284 is adjustable relative to connector tube 286 and connector tube 288, as shown. The preferred adjustability of scissor-type coupler 280 assists efficient assembly of umbrella-type shade module 250. Thus, the above-described preferred arrangement facilitates assembly of the system by providing sufficient levels of adjustment to overcome geometrical inconsistencies.

Preferably, connector tube 284, connector tube 286, and connector tube 288 comprise open-end sockets 292 for receiving end portions of the curved support members (first curved support 270, second curved support 272, third curved support 274, and fourth curved support 277). The inner diameter of each end socket 292 is slightly larger than the outer diameter of each curved support member to enable inserted engagement of the member within end socket 292.

Figure 36:
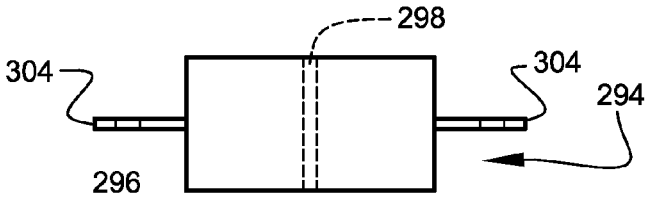
FIG. 36 shows a side view of the adjustable coupler of FIG. 31.
Figure 37:
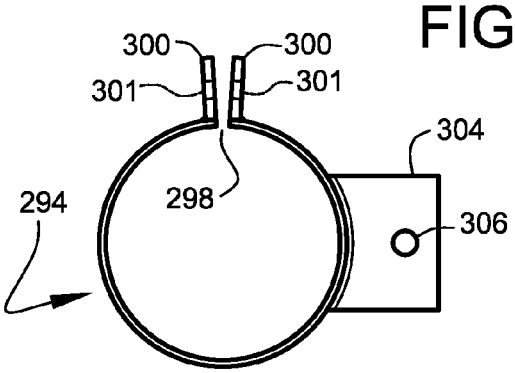
FIG. 37 shows a top view of a single-support adjustable coupler according to the preferred embodiment of FIG. 31.
Figure 38:
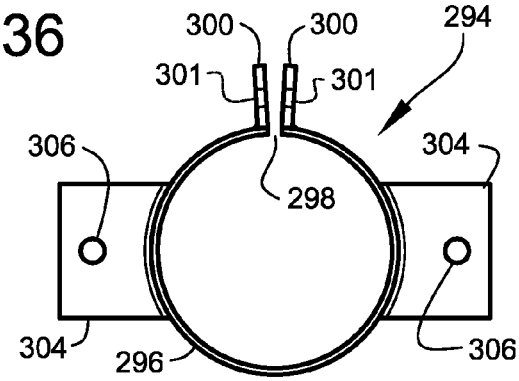
FIG. 38 shows a top view of a double-support adjustable coupler according to the preferred embodiment of FIG. 31.

FIG. 36 shows a side view of adjustable coupler 278 of FIG. 31. FIG. 37 shows a top view of a single-support adjustable coupler 278 according to the preferred embodiment of FIG. 31. FIG. 38 shows a top view of a double-support adjustable coupler 278 according to the preferred embodiment of FIG. 31.

Preferably, adjustable coupler 278 comprises a clamping device adapted to be mountable to the exterior circumference of primary support member 254. Preferably, adjustable coupler 278 comprises a hollow cylindrical sleeve 296 having an interior diameter closely matching that of the exterior diameter of primary support member 254. Preferably, gap 298 splits sleeve 296 along a pair of clamping flanges 300, as shown. Preferably, clamping flanges 300 comprise apertures 301 adapted to receive threaded fasteners 302 (see FIG. 39). Preferably, threaded fasteners 302 are used to draw gap 298 closed, thus reducing the inner diameter of sleeve 296. This preferred arrangement allows sleeve 296 to be firmly clamped against the outer circumference of primary support member 254, and preferably allows adjustable coupler 278 to be later repositioned, as required. Preferably, sleeve 296 further comprises at least one mounting plate 304, as shown in FIG. 37, or two mounting plates 304, as shown in FIG. 38. Preferably, mounting plate 304 is adapted to support corner couplers 276. Preferably, each mounting plate 304 preferably comprise mounting aperture 306 used in conjunction with threaded fasteners 302 to retain corner couplers 276 in the preferred assembly positions.

Figure 39:
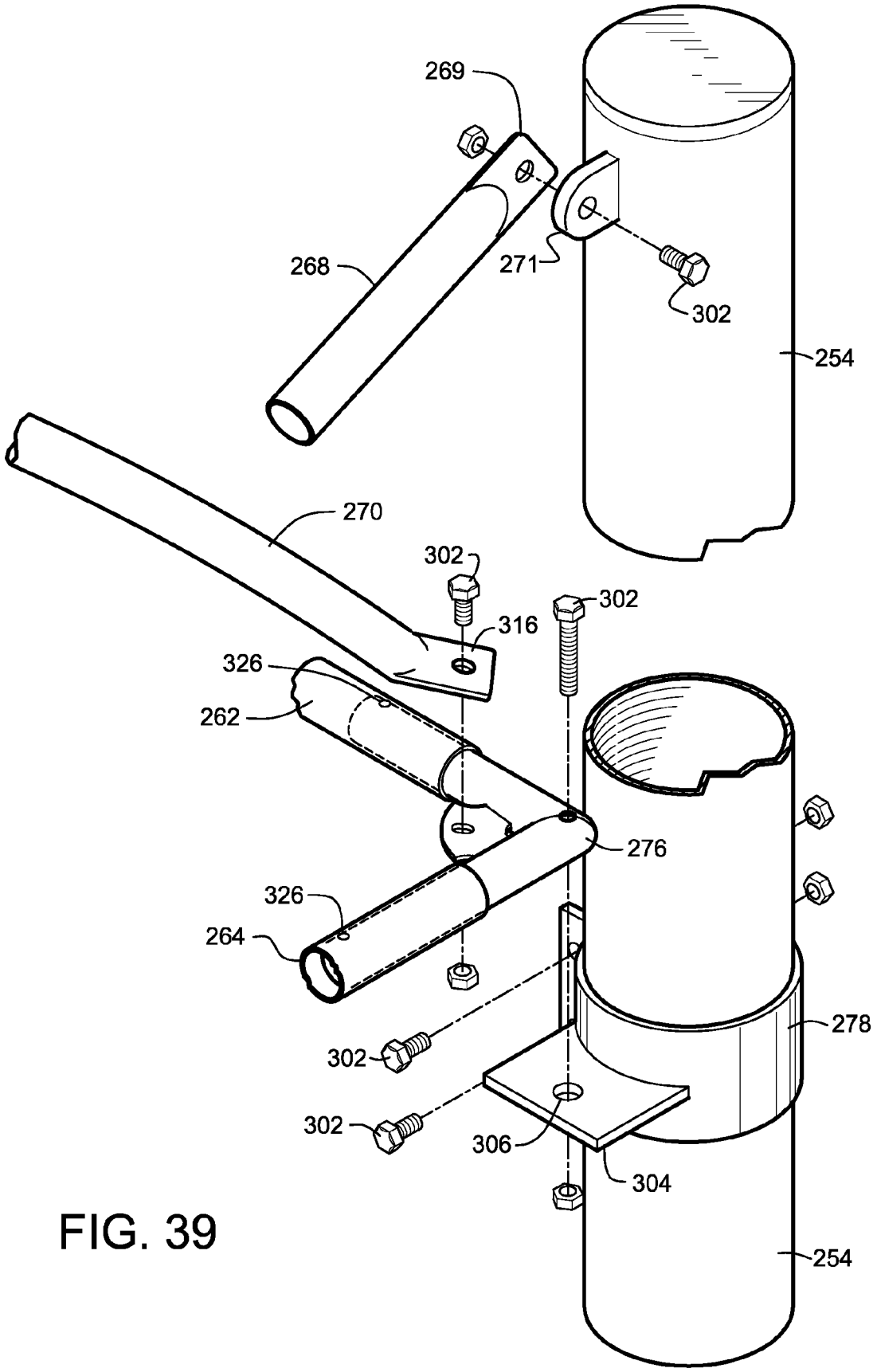
FIG. 39 shows an exploded perspective view of structural member connections adjacent the primary support member of the umbrella-type shade module of FIG. 26.
Figure 40:
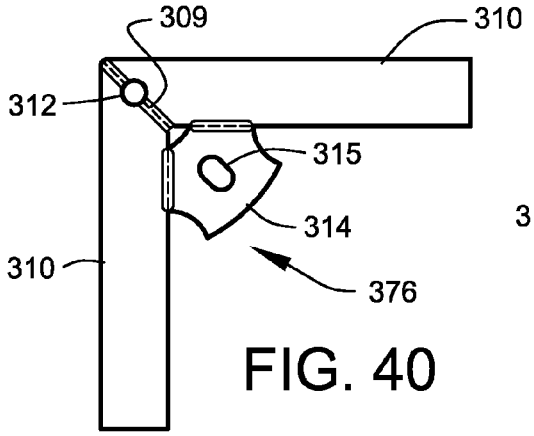
FIG. 40 shows a top view of the corner coupler of FIG. 32.
Figure 41:
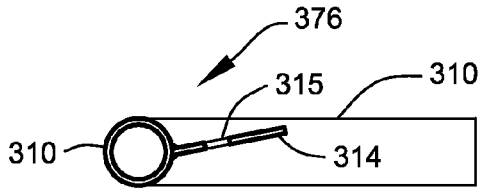
FIG. 41 shows a side view of the corner coupler of FIG. 32.

FIG. 39 shows an exploded perspective view of structural member connections adjacent primary support member 254 of umbrella-type shade module 250 of FIG. 26 (the assembly of the opposite inner corner is substantially identical). FIG. 40 shows a top view of corner coupler 276 of FIG. 32. FIG. 41 shows a side view of the corner coupler 276 of FIG. 32.

Preferably, upper end connection 269 of second upper diagonal member 268 is coupled to mounting tab 271, as shown. Preferably, mounting tab 271 is permanently fastened, preferably welded to the upper end of primary support member 254, as shown. Upon reading the teachings of this specification, those of ordinary skill in the art will now understand that, under appropriate circumstances, considering such issues as cost, assembly preference, etc., other tab-mounting arrangements, such as, utilizing a vertically adjustable tab device similar to the lower adjustable couple, etc., may suffice. Note the preferred capping of primary support member 254 clearly depicted in FIG. 39.

Preferably, the inner corner couplers 276 are used to couple adjacent horizontal framing segments (at least embodying herein straight peripheral-portion elements) and supportively connects with lower connection ends 316 of curved support members (for example, first curved support 270 depicted in FIG. 39). Preferably, lower end connection 316 is formed by flattening the end of the curved support member, and bending the flattened portion to an angle assisting a bolted connection with corner coupler 276, as shown. Preferably, lower end connection 316 comprises mounting aperture 320 allowing the use of a threaded connector 302 to mount lower end connection 316 to corner coupler 276, as shown. In the assembly of FIG. 39, corner coupler 276 couples third horizontal segment 262 to fourth horizontal segment 264, as shown.

Corner coupler 276 preferably comprises two hollow cylindrical members 310 permanently joined at a 90-degree miter joint 309, as shown. Preferably, the length of each hollow cylindrical member 310 (as measured from the outer corner of the miter joint) is about 28 centimeters. The preferred outer diameter of each hollow cylindrical member 310 is about 50 millimeters, which allows hollow cylindrical members 310 to engage interior end sockets of the horizontal segments forming peripheral frame 275, as shown in FIG. 39. Preferably, corner coupler 276 comprises mounting aperture 312, preferably used to couple upper diagonal members to corner coupler 276 at miter joint 309 and to couple corner coupler 276 to mounting plate 304, as shown in FIG. 39. Preferably, aperture 312 passes fully through corner coupler 276 and preferably comprises an axis generally perpendicular to the longitudinal axes of hollow cylindrical members 310, as shown.

Preferably, hollow cylindrical member 310 comprises mounting plate 314, as shown. Preferably, mounting plate 314 is permanently attached to corner coupler 276 at the interior corner formed by hollow cylindrical members 310. Preferably, mounting plate 314 comprises at least one mounting aperture, preferably elongated aperture 315 allowing an adjustable bolted connection with lower connection end 316 of a curved support member. Thus, the above-described preferred arrangement facilitates assembly of the system by providing sufficient levels of adjustment to overcome geometrical inconsistencies.

Preferably, mounting plate 314 is welded to hollow cylindrical members 310 an angle of about 35 degrees from horizontal, as shown. This preferred mounted position reduces the angle at which lower connection end 316 must be bent to develop a matching bolted connection with mounting plate 314. This preferred feature greatly increases the overall strength of lower connection end 316 by avoiding weakening of the material occurring with severe angles of bend.

Figure 42:
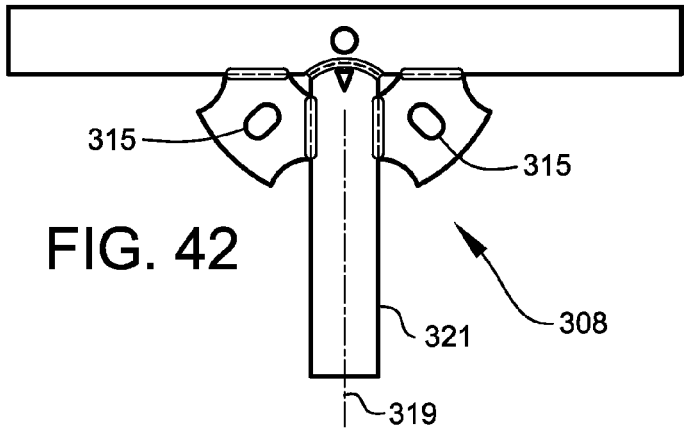
FIG. 42 shows a top view of the T-type coupler of FIG. 33.

FIG. 42 shows a top view of the T-type coupler 308 of FIG. 33. T-type coupler 308 is preferably used to develop a range of preferred "multi-module" embodiments comprising two or more flexible umbrella shade elements 257 of two or more umbrella-types shade module 250. More specifically, T-type coupler 308 is adapted to couple adjacent flexible umbrella shade elements 257 at a single primary support member 254. In this preferred arrangement, two adjacent peripheral frames 275 share one common horizontal segment 317, as best illustrated in FIG. 45 (at least embodying herein wherein such at least one third such straight peripheral-portion element is shared by such at one first at least one flexible umbrella shade element and such at one second at least one flexible umbrella shade element).

The preferred configuration of T-type coupler 308 (at least embodying herein at least one fourth connector structured and arranged to connect at least one first such straight peripheral-portion element, of at least one first at least one flexible umbrella shade element to at least one second such straight peripheral-portion element, of at least one second at least one flexible umbrella shade element) essentially matches that of corner coupler 276, modified to be bisymmetrical about axis 319 of hollow cylindrical member 321, as shown. Preferably, T-type coupler 308 is structured and arranged to maintain a first horizontal framing segments (straight peripheral-portion element) and a second horizontal framing segments (straight peripheral-portion element) in a substantially co-axial arrangement, as shown.

Figure 43:
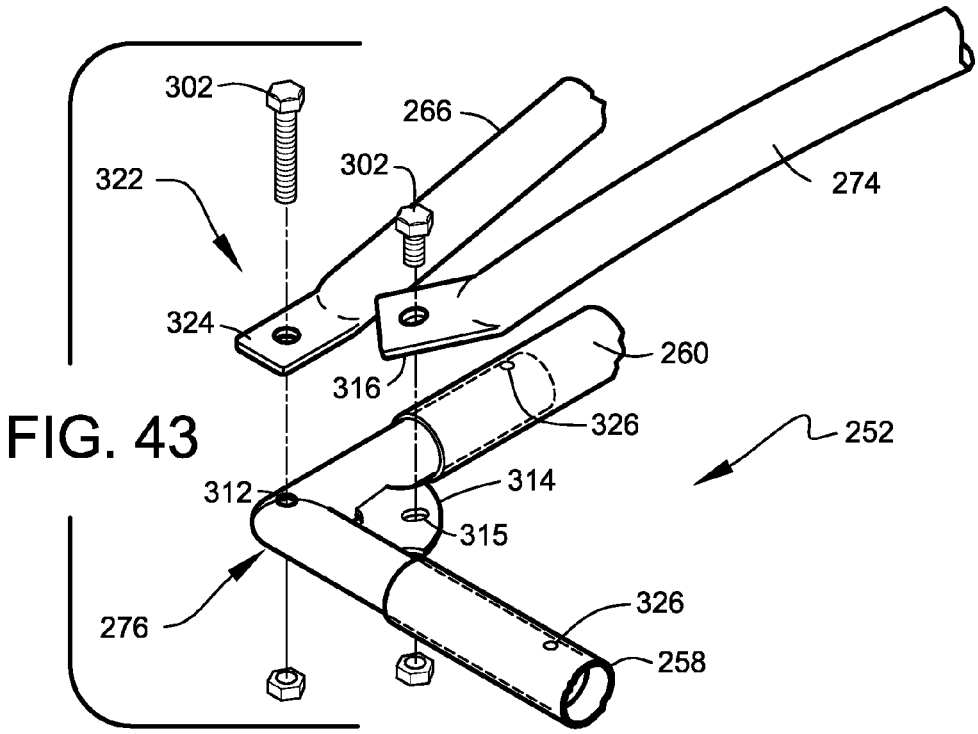
FIG. 43 shows an exploded perspective view of structural member connections at an outer corner of the umbrella-type shade module of FIG. 26.

FIG. 43 shows an exploded perspective view of structural member connections at outer corner 322 of umbrella-type shade module 250 of FIG. 26. Preferably, the adjustable assembly of the opposite outer corner is substantially identical.

Preferably, the outer corner coupler 276 couples first horizontal segment 258 to second horizontal segment 260, as shown. Preferably, lower end connection 324 of first upper diagonal member 266 is coupled to corner coupler 276 at aperture 312, as shown. Preferably, lower end connection 316 of third curved support 274 is coupled to mounting plate 314, as shown. Preferably, a screw 326 is used to adjustably secure each tube-to-socket engagement, as shown. Preferably, structural frame 252 is assembled using appropriately sized threaded fasteners 302, most preferably comprising threaded bolts and nuts, as shown. Upon reading the teachings of this specification, those of ordinary skill in the art will now understand that, under appropriate circumstances, considering such issues as intended use, cost, selection of materials, etc., other fastener arrangements, such as, welds, clamps, quick-release fasteners, etc., may suffice.

FIG. 44 shows a top view diagram of a single module of umbrella-type shade module 250 FIG. 26. FIG. 45 shows a rear view diagram of a single module of umbrella-type shade module 250 of FIG. 26. FIG. 46 shows a side view diagram of a single module of umbrella-type shade module 250 of FIG. 26.

FIG. 47 shows a top view diagram of a multiple unit of umbrella-type shade module 250 of FIG. 26, comprising side-by-side configuration 350, according to a preferred embodiment of the present invention. FIG. 48 shows a rear view diagram of side-by-side configuration 350 of FIG. 47.

FIG. 49 shows a top view diagram of a multiple unit of umbrella-type shade module 250 of FIG. 26, comprising back-to-back configuration 352, according to a preferred embodiment of the present invention. FIG. 50 shows a side view diagram of back-to-back configuration 352 of FIG. 49.

FIG. 51 shows a side view of a single alternate umbrella-type shade module 360, comprising modified support structure 362, according to an alternate preferred embodiment of the present invention. Preferably, modified support structure 362 comprises additional structural reinforcing to extend the use of alternate umbrella-type shade module 360 to geographic regions subjected to greater environmental force loads. Preferably, the structures and arrangements of alternate umbrella-type shade module 360 substantially match those of umbrella-type shade module 250, except as noted below.

Preferably, alternate umbrella-type shade module 360 comprises an additional vertical link 364 connecting horizontal segment 366 with upper diagonal member 368, as shown. Vertical link 364 is preferably located at about the mid span of each member and preferably forms a truss-like structure along each side of alternate umbrella-type shade module 360, as shown. In addition, the profile of curved support assembly 370 is modified to bring apex 372 of the umbrella to an elevation substantially matching the upper connection point between vertical link 364 and upper diagonal member 368, as shown. This preferred arrangement facilitates the application of additional horizontal support members 374 linking apex 372 to upper diagonal member 368, as shown.

FIG. 52 shows a side view of a double umbrella-type shade assembly 380, comprising modified support structure 362 of FIG. 51, according to an alternate preferred embodiment of the present invention. In the preferred embodiment of FIG. 52, apexes 372 of adjoining shade modules have been joined by horizontal support member 374, as shown. This preferred arrangement adds additional stiffness to structural framing and provides opportunities to produce alternate canopy shapes, as shown.

FIG. 53 shows a top view of another double (side-by-side) umbrella-type shade assembly, comprising modified support structure 362 and corresponding canopy shape, according to another alternate preferred embodiment of the present invention. In the preferred embodiment of FIG. 53, apexes 372 of adjoining shade modules have been joined by horizontal support member 374 to form an elongated canopy vault, as shown. FIG. 54 shows a top view of double umbrella-type shade module 380, comprising a modified support structure 362, according to the alternate preferred embodiment of FIG. 52.

Figure 55:
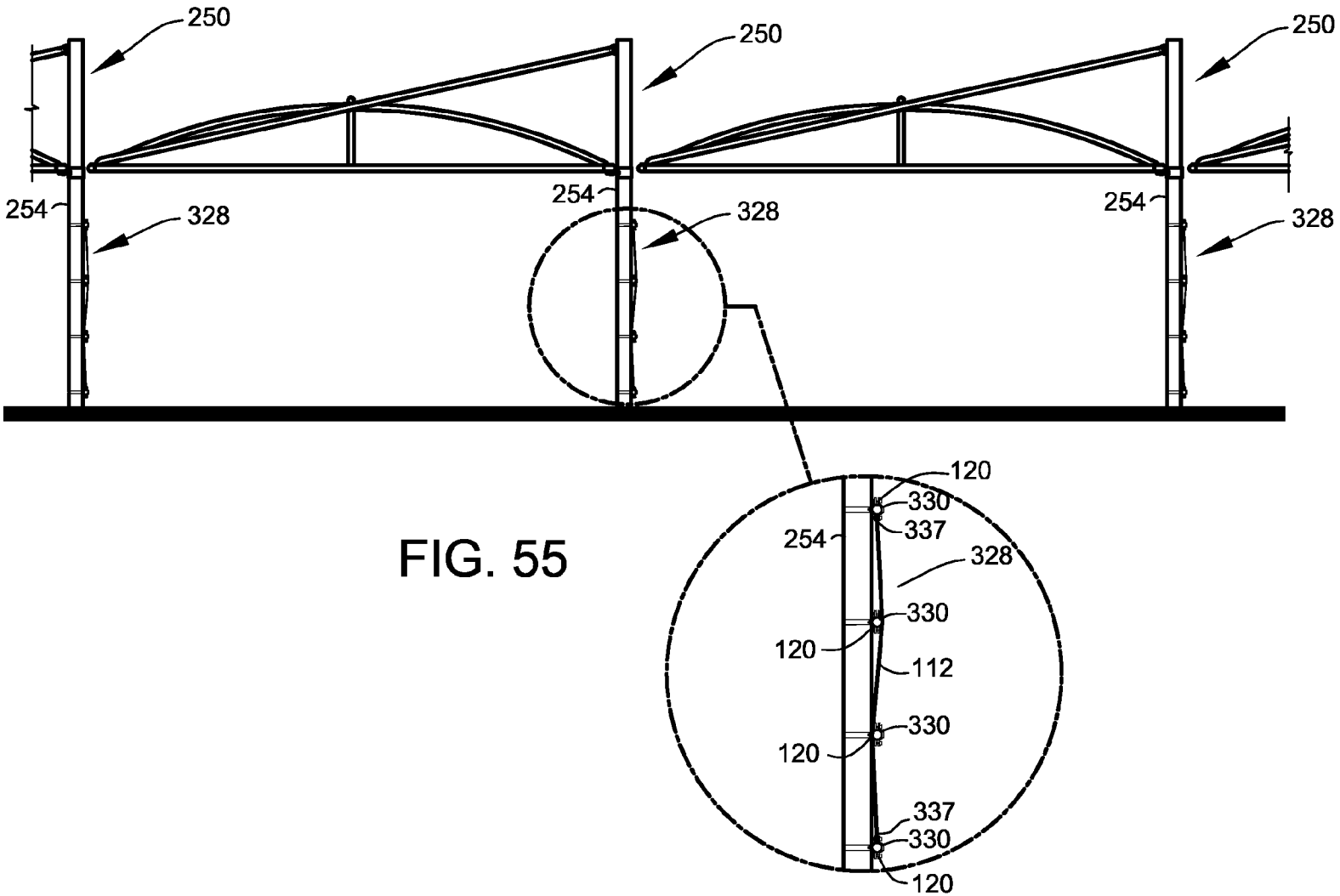
FIG. 55 shows a side view of a plurality of the umbrella-type shade modules, comprising flexible vertical divider panels, according to another preferred embodiment of the present invention.

FIG. 55 shows a side view of a plurality of umbrella-type shade modules 250 comprising flexible divider panels 328, according to another preferred embodiment of the present invention (at least embodying herein at least one visual separator). Preferably, a series of umbrella-type shade modules 250 are configured as individual "bays" by the preferred application of flexible divider panels 328, as shown (at least embodying herein at least one substantially flexible separator). Preferably, flexible divider panels 328 comprise a vertically oriented flexible fabric panel having top and bottom peripheral edges 337 affixed to transverse support bars 330, as shown. Preferably, transverse support bars 330 extend between primary support members 254 and are preferably secured using transverse coupler assemblies 120, as shown. Preferably, a plurality of transverse support bars 330 are used such that flexible shade material 112 of flexible divider panels 328 can be mounted to the shade structure in an alternating "woven" pattern, as shown. This preferred arrangement provides visual separation between the areas residing under the individual shade modules, as shown.

Figure 56:
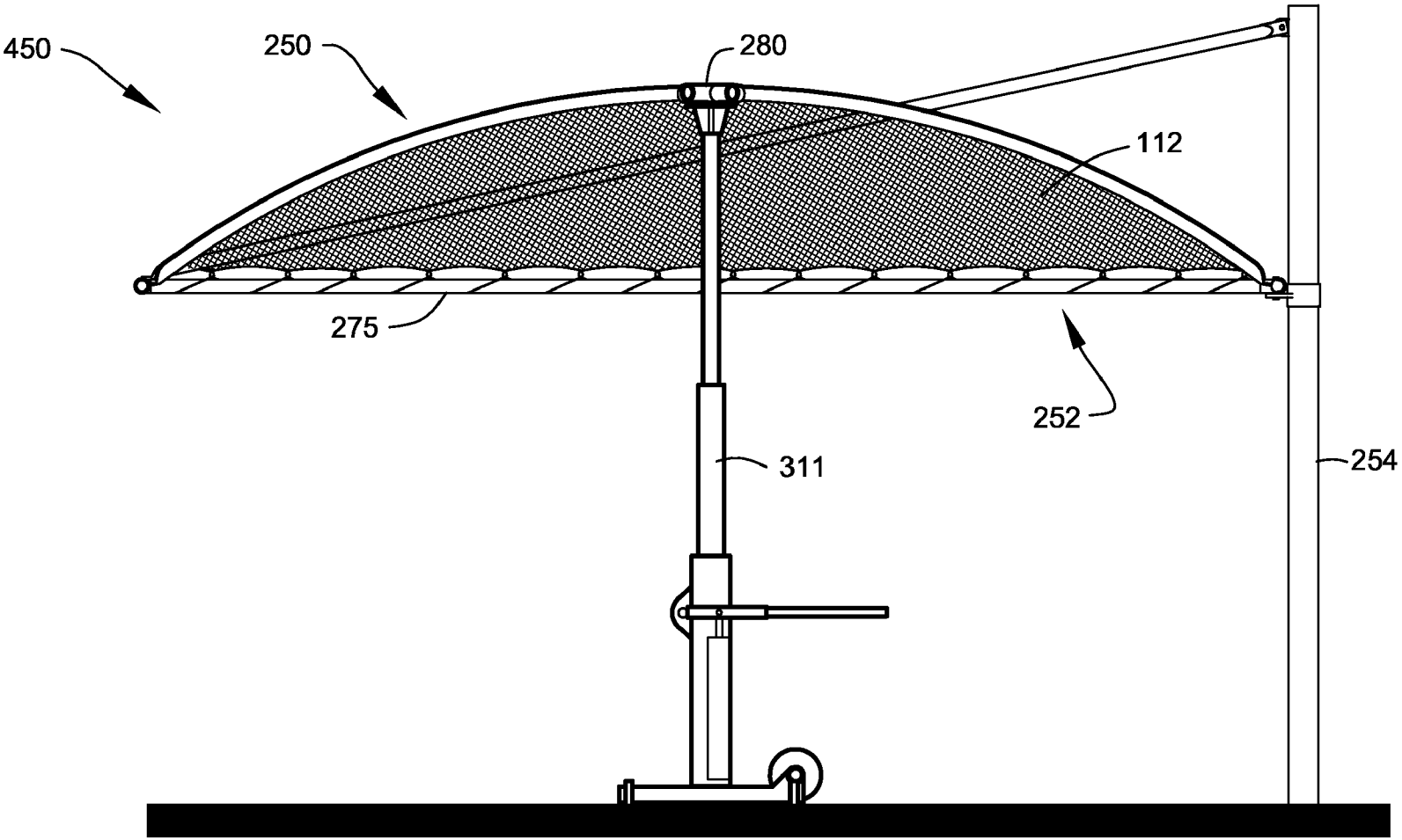
FIG. 56 shows a side view, in partial section, illustrating a preferred assembly step in the assembly of the umbrella-type shade module, according to a preferred method of the present invention.

FIG. 56 shows a side view, in partial section, illustrating a preferred assembly step in the assembly of umbrella-type shade module 250 according to preferred method 450 of the present invention. It has been observed that failure of the flexible shade material is often attributable to mechanical wear caused by the repeated movement of the material against the rigid supporting structure. Over time, this mechanical wear produces wear holes that necessitate the replacement of the flexible shade material (for example, flexible shade material 112 within umbrella-type shade module 250). Installing flexible shade material 112 to structural frame 252 under increased tension assists in reducing mechanical wear by immobilizing flexible shade material 112 relative to the structure. In a highly preferred installation method, flexible shade material 112 is "post-tensioned", after the lacing of flexible shade material 112 to peripheral frame 275, by the vertical "hoisting/jacking" of structural frame 252, preferably at scissor-type coupler 280, as shown.

Preferably, flexible shade material 112 is first laced tightly to peripheral frame 275, as shown. Preferably, bolted and screwed connections between the cantilevered structural members of structural frame 252 initially remain loosely tightened until the vertical "hoisting/jacking" of the structure is completed. Preferably, a vertical force is applied to the underside of scissor-type coupler 280 by operation of jack 311, as shown. Preferably, the upward force jack 311 modifies the shape of the support structure increasing the tension of flexible shade material 112. Once the preferred level of tension is achieved, structural frame 252 is positionally secured with all mechanical fasteners installed and tightened. Preferably, jack 311 is then removed leaving flexible shade material 112 in the preferred state of tension.

Figure 58:
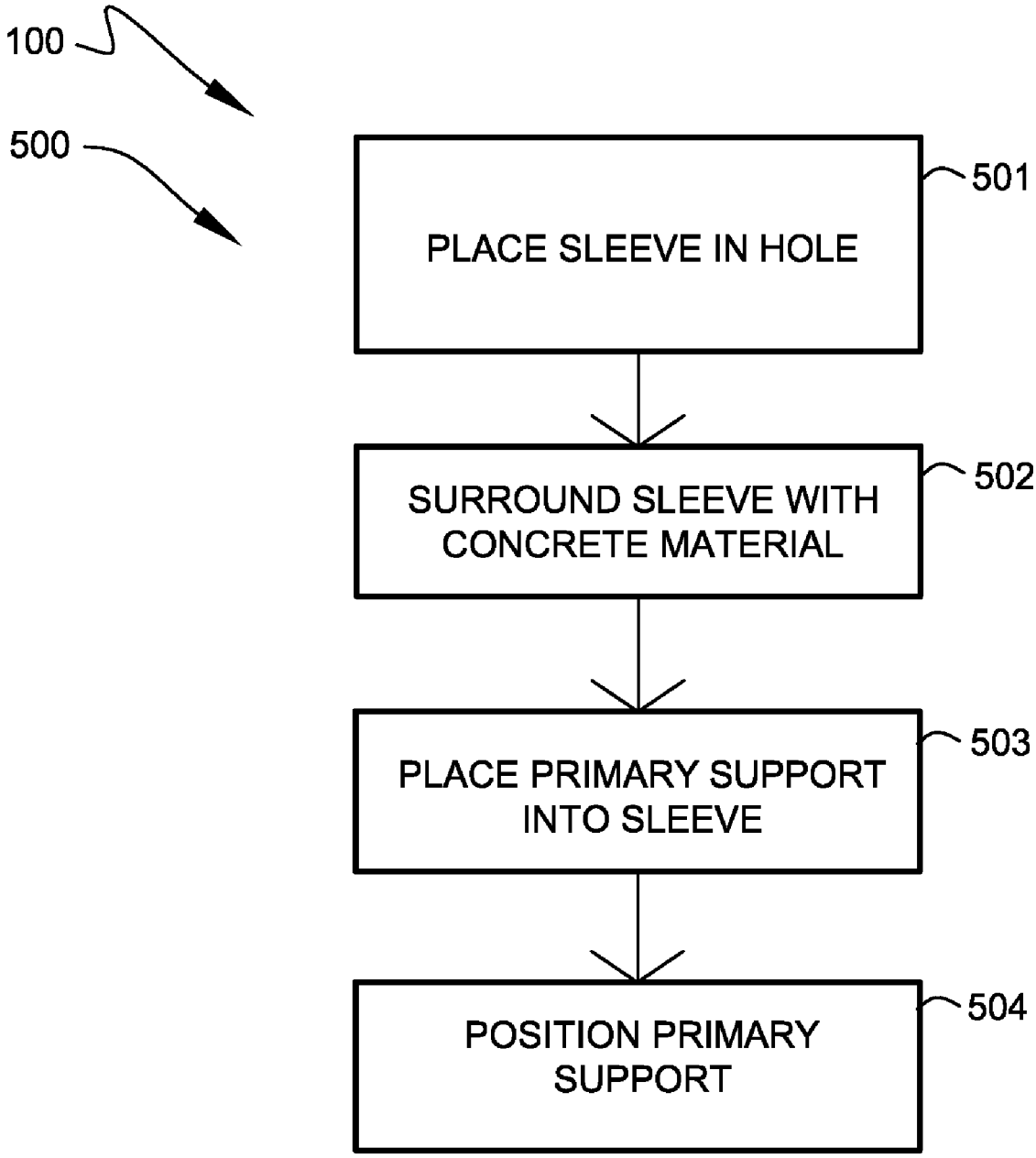
FIG. 58 shows a diagram describing a preferred method of developing a preferred mounting assembly, according to a preferred embodiment of the present invention.

As shown in diagram of FIG. 58, and with special reference to FIG. 2, and with continued reference to FIG. 1 through FIG. 53, shade system 100 preferably comprises method 500 comprising the steps of: (501) placing at least one sleeve 124 into at least one hole formed within ground soil 122; (502) surrounding the at least one sleeve 124 with at least one concrete material 125; (503) placing at least one primary support member 104 into such at least one sleeve 124; and (504) positioning such at least one primary support member 104; wherein such step of positioning comprises placing at least one depth-controller, preferably comprising a base of gravel 128 inside the at least one sleeve 124 so as to adjust the depth of such at least one primary support member 104.

Method 500 preferably provides a stable foundation, supported at a specifically desired height. Method 500 is preferably applicable to each of the above-described embodiments of shade system 100, including embodiments of shade system 100 utilizing arch-type shade module 102 and embodiments of shade system 100 utilizing umbrella-type shade module 250.

According to a preferred method of the present invention, holes to receive foundation structures 106 are excavated under the preferred location of each the primary shade support members (primary support member 104 or primary support member 254). A datum elevation, preferably a level line is preferably is establish near the surface of ground soil 122. This datum elevation is used by the fabricator to set the elevation of the base ends of the primary shade support members. In practical application, the datum elevation is established by the placement of a level string extending between two stakes driven into ground soil 122 generally adjacent to the excavated holes. Sleeves 124, preferably a hollow cylindrical pipe, are preferably placed vertically in each of the excavated holes. Preferably, sleeves 124 have an inner diameter greater than the outer diameter of the primary shade support member intended to be positioned in that hole.

Each hole is preferably filled with concrete material 125, preferably surrounding the base and sides of sleeve 124, without any concrete entering the interior of sleeve 124. Once the concrete has dried, a depth controller, preferably a plurality of rocks, preferably gravel 128, is placed inside the base of sleeves 124 so as to provide sensitive depth adjustment control of the primary shade support member. The use of gravel 128 allows for height adjustment of the entire structure, so as to allow for consistent placement of shades, uniform in height, across a site. Gravel 128 is preferably compacted, so as to prevent future shifting or settling of gravel 128, which would undesirably affect the position of the primary shade support member. The base of the primary shade support member is preferably then placed inside sleeve 124. The primary shade support member may be removed, and more gravel added, in order to control and readjust the height of the primary shade support member.

Throughout the process, additional position controls are preferably utilized, such as levels, tape measures and other references and/or measuring devices, in order to ensure proper positioning of the entire system, as to create a uniform shade structure compliant with municipal codes and regulations, matching specific height and esthetic codes and regulations.

Furthermore, wedges, preferably wood, are position at the top of sleeve 124, preferably hammered in, between sleeve 124 and the primary shade support members, preferably in order to allow for slight adjustments to the vertical orientation of the primary shade support member. In addition, a packing material, more preferably an inert granular material, most preferably sand is preferably packed inside sleeve 124, to fill in the interstitial space between the rocks, primary shade support member, and sleeve 124, preferably so as to prevent future shifting or settling, which would undesirably affect the position of the shade support member. Preferably, substantially all such at least one granular material passes an aperture having a diameter of about 12 millimeters; and such granular quality of such at least one packing material remains after such packing.

In an alternate preferred embodiment (see also FIG. 2), a collar, preferably concrete grout 127, is preferably applied on the top area of sleeve 124, preferably so as to collar the shade support member, as well as improve esthetics by hiding sleeve 124 and/or wedges.

Figures 59, 60:
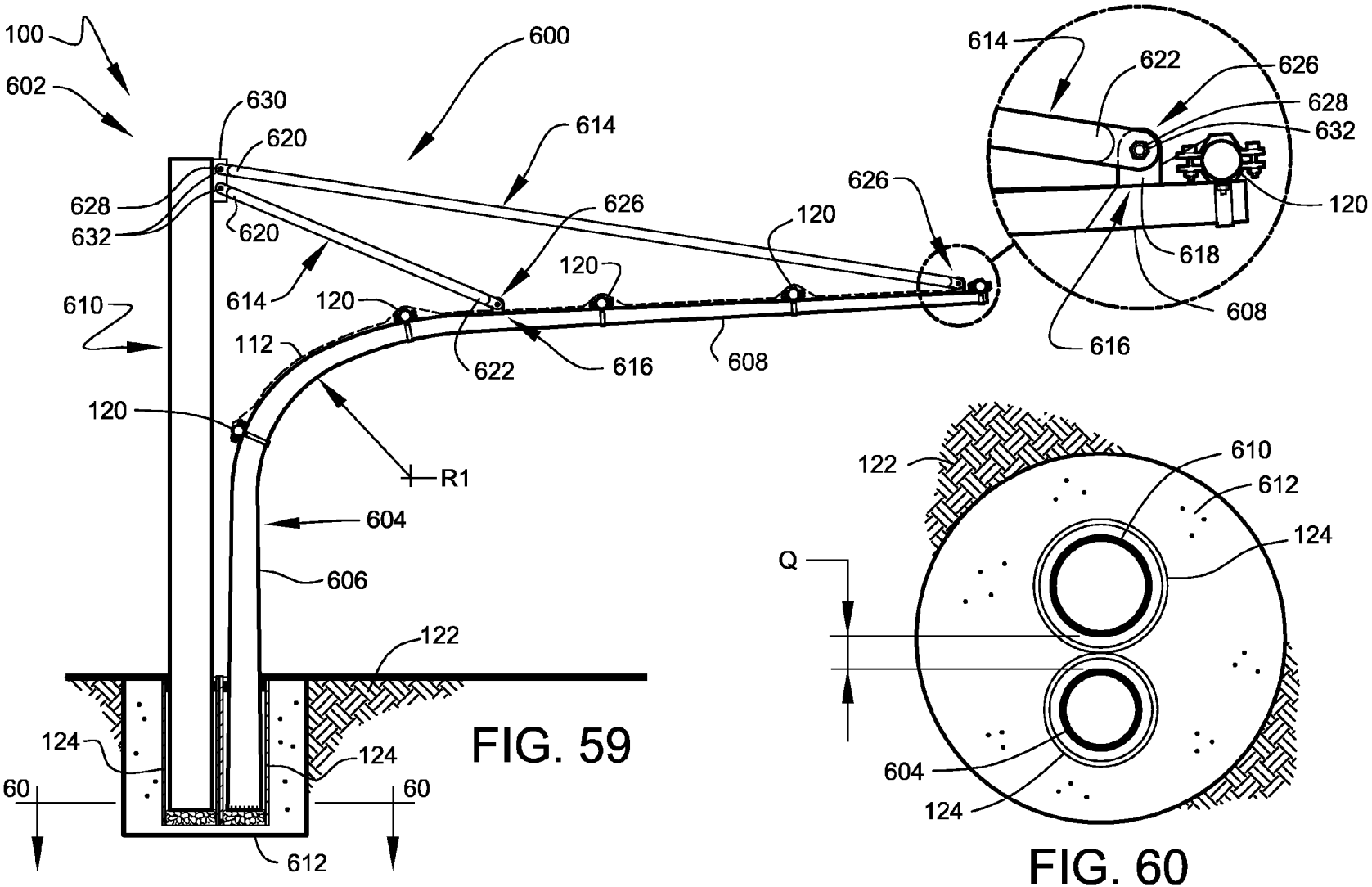
FIG. 59 shows a side view illustrating a fixed cantilever support system adapted to provide additional structural support to the primary support member of an alternate arch-type shade module, according to an alternate preferred embodiment of the present invention.
FIG. 60 shows a sectional view through the section 60-60 of FIG. 59 illustrating a preferred relationship between support-receiving sleeves of the alternate preferred embodiment of FIG. 59.

FIG. 59 shows a side view illustrating alternate arch-type shade module 602 according to an alternate preferred embodiment of shade system 100. The use of alternate arch-type shade module 602 is preferred in geographic regions subject to heavy environmental loads. This preferably includes regions experiencing moderate to heavy snowfall, moderate to heavy wind loads, or a combination of both loading conditions. The use of alternate arch-type shade module 602 is also preferred where local regulations restrict the use of deployable cantilever support system 222 of FIG. 24.

Preferably, alternate arch-type shade module 602 substantially matches the structure and arrangements of arch-type shade module 102 of FIG. 1, with the preferred addition of fixed cantilever support system 600, as described below. Fixed cantilever support system 600 is preferably adapted to provide additional structural support to primary support member 604 (equivalent to primary support member 104), as shown. Thus, primary support member 604 preferably comprises at least one substantially vertical base segment 606 smoothly transitioning along radius R1 (preferably comprising a segment length of about one and one-half meters) extending upwardly from vertical base segment 606 to preferably form at least one substantially horizontal end segment 608, as shown. As with primary support member 104, each primary support member 604 is constructed from a substantially rigid structural material, preferably a metallic material, most preferably from a mild steel sheet having a thickness of at least about four millimeters (mm). Preferably, the mild steel sheet is rolled and welded to form a conically shaped hollow member having a base diameter of about 130 millimeters and an ending diameter of about 60 millimeters. Preferably, primary support members 604 comprise a projecting length of about five meters and a maximum projecting height, as measured from the adjacent ground surface, of about two and one-half meters.

Preferably, a plurality of transverse coupler assemblies 120 span between adjacent primary support members 604, in a manner substantially similar to the prior embodiments (see FIG. 22). Preferably, the interspacing of the primary support members 604 establishes the width of a single module and most preferably comprises a center-to-center distance of about five meters. Alternate arch-type shade module 602 is preferably structured and arranged to support flexible shade material 112 (at least embodying herein at least one flexible shade element) in at least one position to provide solar shading during daylight times, as shown.

Preferably, fixed cantilever support system 600 of alternate arch-type shade module 602 comprises at least one substantially vertical secondary support member 610, as shown. Preferably, secondary support member 610 is structured and arranged to provide secondary structural support substantially independent of primary support members 604, as shown.

The basic design of secondary support member 610 is preferably derived from the previously described design of primary support member 254. Preferably, each secondary support member 610 comprises a substantially circular cross section, preferably a substantially uniform cross section having a preferred diameter of about 160 millimeters and a wall thickness of about four millimeters. Preferably, the tops of each secondary support member 610 is capped to prevent rain water or other material from entering the structural element.

Preferably, alternate arch-type shade module 602 is supported within a foundation structure, more preferably by a single common foundation structure 612, preferably adapted to stably support the system within the adjacent ground structure (ground soil 122), as shown (at least embodying herein a common foundation support structured and arranged to stably support both such at least one shade support member and such at least one substantially vertical secondary support member). Preferably, each vertical base segment 606 projects upwardly from an engagement with foundation structure 612, as shown. Preferably, each secondary support member 610 comprises two ends with the lower end also projecting upwardly from an engagement with foundation structure 612, as shown.

Preferably, each secondary support member 610 further comprises at least one, most preferably two connector bars 614, as shown. Preferably, each connector bar 614 provides a structural connection between secondary support member 610 and horizontal end segment 608, as shown, thus providing independent auxiliary cantilevered support to horizontal end segment 608. Preferably, each connector bar 614 comprises a rigid bar capable of transferring both tension and compression forces. Preferably, each connector bar 614 comprises an elongated circular pipe, preferably comprising a minimum diameter of about 60 millimeters and a minimum wall thickness of about two and one half millimeters.

Preferably, each connector bar 614 comprises first bar end 620 and second bar end 622, as shown. Preferably, a first connector assembly 624 is provided at first bar end 620 to connect connector bar 614 to mounting plate 630 of secondary support member 610, as shown. Preferably, mounting plate 630 is permanently fastened, preferably welded to the upper end of secondary support member 610, as shown. Upon reading the teachings of this specification, those of ordinary skill in the art will now understand that, under appropriate circumstances, considering such issues as cost, assembly preference, etc., other mounting arrangements, such as, utilizing a vertically adjustable mounting plate, etc., may suffice. Preferably, first bar end 620 is coupled to mounting plate 630 using bolted connection 632, as shown.

Preferably, a second connector assembly 626 is provided at second bar end 622 to connect connector bar 614 to horizontal end segment 608, as shown. Preferably, horizontal end segment 608 is equipped with at least one, most preferably two connection points 616, as best shown in the enlarged detail of FIG. 59. Preferably, each connection point 616 is adapted to couple with second bar end 622 using another bolted connection 632, as shown. Preferably, each connection point 616 comprises a connector tab 618, as shown. Preferably connector tab 618 comprises a rigid metallic plate projecting from the upper surface of horizontal end segment 608, as shown. Preferably, connector tab 618 is permanently fastened, preferably welded to the upper surface of horizontal end segment 608, as shown.

Preferably, for each connector bar 614 of fixed cantilever support system 600, at least one of the above-described connector assemblies (first connector assembly 624 or second connector assembly 626) comprises a hinged connection, most preferably bolted connection 632, as shown. Most preferably, both first connector assembly 624 and second connector assembly 626 comprise bolted connections, as shown. Upon reading the teachings of this specification, those of ordinary skill in the art will now understand that, under appropriate circumstances, considering such issues as intended use, local codes, preferred assembly methodology, etc., other coupling arrangements, such as permanent welding, use of adjustable couplers, clamp assemblies, etc., may suffice.

Preferably, first bar end 620 and second bar end 622 are each formed by flattening the ends of connector bar 614, as shown. Preferably, first bar end 620 and second bar end 622 each is receive an aperture 628 allowing the assembly of bolted connection 632.

FIG. 60 shows a sectional view through the section 60-60 of FIG. 59 illustrating a preferred relationship between support-receiving sleeves 124 of alternate arch-type shade module 602 of FIG. 59. As with arch-type shade module 102, primary support member 604 is removeably mounted within foundation structure 612, preferably by embedment within a sand-packed sleeve 124. Moreover, as with primary support member 254 of umbrella-type shade module 250, preferably, secondary support member 610 is removeably mounted within foundation structure 612, preferably by embedment within a second sand-packed sleeve 124 (see FIG. 2 for similar foundation mounting arrangements).

Preferably, primary support member 604 and secondary support member 610 are closely situated within foundation structure 612, as shown. Preferably, primary support member 604 and secondary support member 610 are separated by at least one distance Q not substantially greater than the combined diameters of primary support member 604 and secondary support member 610. For example, if primary support member 604 comprises a preferred base diameter of about 130 millimeters, and secondary support member 610 comprises a preferred diameter of about 160 millimeters, the maximum distance Q between vertical members shall not exceed about 290 millimeters. In most installations it is preferred that primary support member 604 and secondary support member 610 be situated as closely as practical within foundation structure 612.

Figure 61:
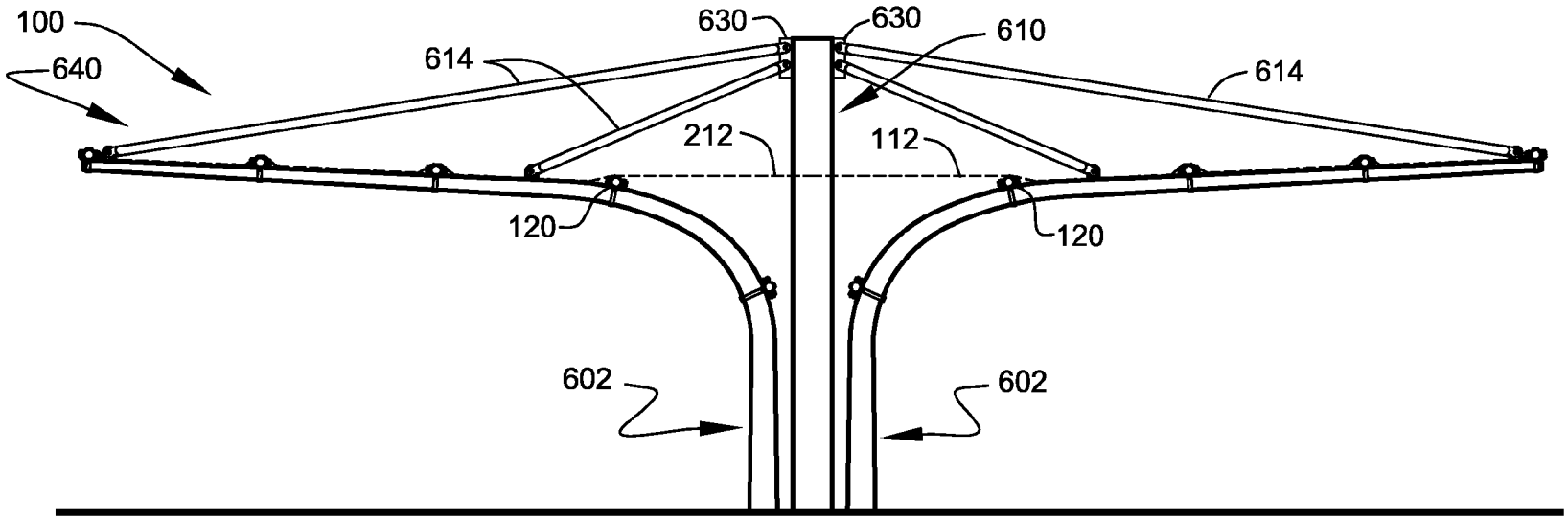
FIG. 61 shows a side view of a back-to-back shade structure, comprising the alternate arch-type shade modules and fixed cantilever support system of FIG. 59, according to another preferred embodiment of the present invention.

FIG. 61 shows a side view of back-to-back shade structure 640, comprising opposing alternate arch-type shade module 602 is symmetrically arranged about a modified embodiment of the central fixed cantilever support system of FIG. 59, according to another preferred embodiment of shade system 100.

Preferably, back-to-back shade structure 640 comprises a single secondary support member 610 supporting two symmetrically opposing primary support members 604, as shown. Preferably, secondary support member 610 comprises two mounting plates 630, as shown. Preferably, each mounting plate 630 is permanently fastened, preferably welded to opposing sides of secondary support member 610, as shown.

Preferably, back-to-back shade structure 640 comprises a common span of flexible shade material 112 identified herein as linking panel 212. Preferably, linking panel 212 spans from a transverse coupler assembly 120 of the first primary support member 604 to a transverse coupler assembly 120 of the second primary support member 604, as shown. Specific preferred installation methodologies related to the application of linking panel 212 is discussed in FIG. 20. Back-to-back shade structure 640 of FIG. 61 is especially useful in shading multi-vehicle parking areas.

Figure 62:
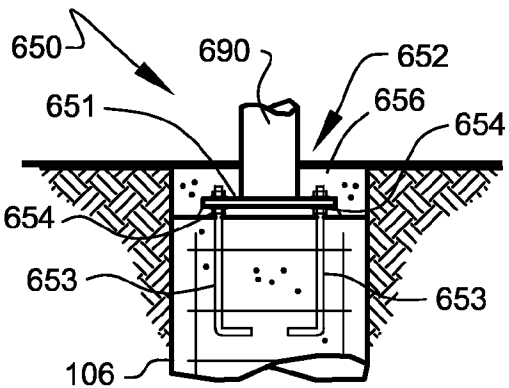
FIG. 62 shows a diagrammatic sectional view through an alternate preferred structural foundation connection.
Figure 63:
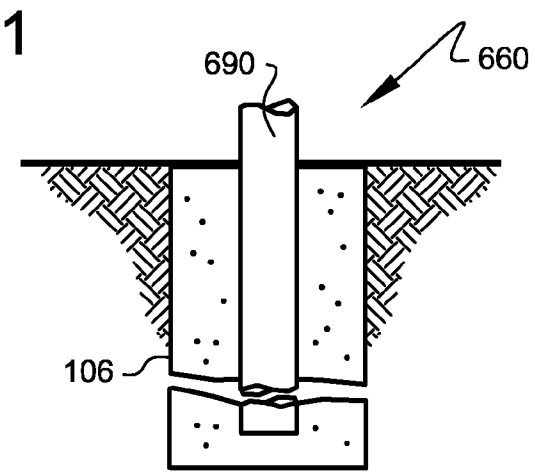
FIG. 63 shows a diagrammatic sectional view through a second alternate preferred structural foundation connection.

FIG. 62 shows a diagrammatic sectional view through alternate preferred structural foundation connection 650. FIG. 63 shows a diagrammatic sectional view through alternate preferred structural foundation connection 660, according to preferred embodiments of the present invention. Alternate preferred structural foundation connection 650 preferably comprises bolted connection 652 used to bolt vertical support member 690 to a reinforced foundation structure 106, as shown. Alternate preferred structural foundation connection 660 preferably comprises a direct embedment of vertical support member 690 within foundation structure 106, as shown. The aforementioned alternate foundation arrangements are preferably used in geographical jurisdictions restricting or prohibiting the use of the removable foundation installation of FIG. 2.

Bolted connection 652 of alternate preferred structural foundation connection 650 preferably comprises the use of a mounting plate 651 welded to the bottom of vertical support member 690, as shown. Preferably, mounting plate 651 is secured by a set of anchor bolts 653 preferably embedded within foundation structure 106, as shown. Preferably, mounting plate 651 is leveled using a set of leveling nuts 654 and is subsequently grouted solid once proper level has been achieved. Preferably, mounting plate 651 may be protectively covered by a cementatous material 656, as shown.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A wind relief system, relating to wind relief within shade elements positioned to provide shading during daylight times, comprising:

a) at least one shading structure comprising i) at least two ground-supported primary support members spaced apart from one another, each primary support member of said at least two ground-supported primary support members structured and arranged to provide elevated support above at least one adjacent ground structure;

ii) wherein each primary support member of said at least two ground-supported primary support members comprises (1) at least one generally vertical support segment structured and arranged to be supported by such at least one adjacent ground structure, (2) at least one cantilevered segment, and (3) bars spaced apart from one another and supported by said at least two ground-supported primary support members, (4) at least one flexible cable secured to said at least two ground-supported primary support members;

iii) shade elements structured and arranged to provide shading;

iv) wherein each shade element of said shade elements comprises peripheral portions;

v) wherein said shade elements are arranged to provide normally uninterrupted shading and wind relief, said shade elements arranged in the following manner (1) at least one peripheral portion of a first shade element connected to a first one of said bars and an opposing peripheral portion of said first shade element connected to said at least one flexible cable;

(2) at least one peripheral portion of a second shade element connected to a second one of said bars;

(3) wherein said opposing peripheral portion of said first shade element connected to said at least one flexible cable overlies said at least one peripheral portion of said second shade element connected to a second one of said bars so that said first shade element and said second shade element are in an overlying arrangement;

(4) wherein wind reacting with under portions of said shade elements causes said at least one flexible cable and its associated shade element to rise and open at least one wind-relieving passage so that air may non-destructively flow through said at least one shading structure.

2. The system according to claim 1 wherein said shade elements each comprise at least one shade fabric.

3. The system according to claim 1 a) wherein each of said at least two ground-supported primary support members comprises at least one radius segment to smoothly transition said at least one generally vertical support segment to said at least one cantilevered segment.

4. The system according to claim 1 wherein said peripheral portions of said shade elements comprise:

a) at least one continuous cord having a plurality of spaced cord loops;

b) wherein said at least one continuous cord is firmly attached with said shade element along its peripheral portion;

c) wherein at least one center of each of said plurality of spaced cord loops is situated at a distance from such cord attachment along said peripheral portion; and d) wherein each of said plurality of spaced cord loops assist connection of said shade elements to said bars or said at least one flexible cable.

5. The system according to claim 1 wherein:

a) said bars each comprise a substantially rigid member extending transversely between said at least two ground-supported primary support members; and b) said at least one flexible cable extends transversely between said at least two ground-supported primary support members.

6. The system according to claim 1, wherein a) said peripheral portions of said shade elements comprise at least one continuous pocket;

b) said at least one continuous pocket comprises at least one continuous cord having a plurality of spaced cord loops spaced along the length of said at least one continuous cord.

7. The system according to claim 1 further comprising:

a) a plurality of ground-mounted sleeves each respectively structured and arranged to transfer force loads to an adjacent ground structure;

b) wherein each said ground-mounted sleeve comprises least one interior wall comprising at least one internal socket;

c) wherein said at least two ground-supported primary support members each comprises at least one first pole-end portion;

d) wherein said at least one internal socket is sized to accommodate said at least one first pole end-portion and interstitial placement of at least one packing material packable between said at least one first pole end-portion and said at least one interior wall;

e) wherein positional adjustments of said plurality of said shade elements is provided by at least one positional adjustment of at least one said at least two ground-supported primary support members within said least one at least one internal socket; and f) wherein at least one preferred position of said shade elements is fixed by packing of such at least one packing material packable between said at least one first pole end-portion and said at least one interior wall.

8. The system according to claim 7 further comprising:

a) such at least one packing material;

b) wherein said at least one packing material comprises at least one substantially inert granular material.

9. The system according to claim 8 wherein:

a) substantially all said at least one granular material passes an aperture having a diameter of about 12 millimeters; and b) such granular quality of said at least one packing material remains substantially unchanged by such packing.

10. The system according to claim 1 wherein at least one portion of each of said at least two ground-supported primary support members is inserted into the ground.

11. The system according to claim 1 wherein said at least one shading structure comprises five of said bars, two of said at least one flexible cable, and wherein said shade elements are arranged so that at least two wind-relief passages open when said shade elements are disturbed by wind.

12. The system according to claim 1 further comprising at least one deployable support to provide auxiliary support for said at least one cantilevered segment, said at least one deployable support having at least one stowed arrangement and at least one deployed arrangement.

13. The system according to claim 12 wherein said at least one deployable support is associated with said at least one cantilevered segment.

14. The system according to claim 13 wherein said at least one deployable support is connected to said at least one cantilevered segment with at least one pivot coupler structured and arranged to pivotally couple said at least one deployable support to said at least one cantilevered segment.

15. The system according to claim 12 wherein said at least one deployable support, when in said at least one deployed arrangement, makes supportive contact with at least one adjacent ground surface.

16. The system according to claim 12 wherein said at least one deployable support, when in said at least one deployed arrangement, makes supportive contact with at least one adjacent ground surface when said at least one shading structure experiences weight loading.

17. The system according to claim 12 further comprising at least one retainer to retain said at least one deployable support in said at least one stowed arrangement.

18. The system according to claim 12 wherein said at least one stowed arrangement positions said at least one deployable support adjacent said at least one cantilevered segment.

19. The system according to claim 1 further comprising at least one ground-connection system to connect each of said at least two ground-supported primary support members with the ground.

20. The system according to claim 19 wherein said at least one ground-connection system comprises at least one sleeve positioned in a hole in the ground, at least one amount of concrete material surrounding said at least one sleeve, and at least one depth controller inside the at least one sleeve to adjust the depth of a ground-supported primary support member.

21. The system according to claim 20 wherein said at least one depth controller comprises at least one rigid granular material.

22. The system according to claim 20 wherein said at least one sleeve is stabilized by at least one collar positioned on a top portion of said at least one sleeve.

23. The system according to claim 1 further comprising at least one secondary support member structured and arranged to provide secondary structural support to said at least one shading structure; wherein said at least one secondary support member is ground supported and extends upward from the ground; and at least one connector bar structured and arranged to connect said at least one secondary support member to at least one of said at least two ground-supported primary support members.

24. The system according to claim 23 further comprising a common foundation support structured and arranged to stably support both at least one of said at least two ground-supported primary support members and said at least one secondary support member from at least one adjacent ground structure.

25. The system according to claim 23 wherein said at least one connector bar comprises a) at least one first bar end and at least one second bar end;

b) at least one first connector structured and arranged to connect said at least one first bar end to said at least one secondary support member; and c) at least one second connector structured and arranged to connect said at least one second bar end to at least one of said at least two ground-supported primary support members.

26. The system according to claim 25 wherein at least one of said at least one first connector and said at least one second connector comprise at least one hinged connection.

27. The system according to claim 1 further comprising two of said at least one shading structure; wherein said at least one cantilevered segment of each of said at least one shading structure are positioned near one another; and wherein said two of said at least one shading structure share at least one portion of said shade elements.

28. The system according to claim 1 further comprising two of said at least one shading structure; wherein said at least one generally vertical support segment of each of said at least one shading structure are positioned near one another; and wherein said two of said at least one shading structure share at least one portion of said shade elements.

* * * * *